US006622408B2

(12) United States Patent
Dicke et al.

(10) Patent No.: US 6,622,408 B2
(45) Date of Patent: Sep. 23, 2003

(54) LIGHTWEIGHT COLLAPSIBLE SIGN

(75) Inventors: Grant D. Dicke, Downers Grove, IL (US); James J. Kokenas, Westmont, IL (US); Donald E. Hans, Romeoville, IL (US)

(73) Assignee: Dicke Tool Company, Downers Grove, IL (US)

( * ) Notice: Subject to any disclaimer, the term of this patent is extended or adjusted under 35 U.S.C. 154(b) by 0 days.

(21) Appl. No.: 10/027,168

(22) Filed: Dec. 20, 2001

(65) Prior Publication Data

US 2002/0121036 A1 Sep. 5, 2002

Related U.S. Application Data

(63) Continuation-in-part of application No. 09/798,681, filed on Mar. 2, 2001.

(51) Int. Cl.[7] ..... G09F 15/00

(52) U.S. Cl. ..... 40/610; 40/608

(58) Field of Search ..... 40/610, 606, 607, 40/608, 607.01, 607.04, 606.01; 248/900, 160, 548

(56) References Cited

U.S. PATENT DOCUMENTS

| | | | | | |
|---|---|---|---|---|---|
| 3,628,296 | A | * | 12/1971 | Henry | |
| 4,201,975 | A | | 5/1980 | Marcus | |
| 4,232,466 | A | | 11/1980 | Mathis | 40/606 |
| 4,236,843 | A | | 12/1980 | Chisholm | |
| 4,490,062 | A | | 12/1984 | Chisholm | |
| 4,548,379 | A | | 10/1985 | Seely et al. | |
| 4,569,499 | A | * | 2/1986 | Seely | 40/608 X |
| 4,593,879 | A | | 6/1986 | Seely et al. | |
| 4,676,015 | A | * | 6/1987 | Stoudt | 40/606 X |
| 4,813,199 | A | | 3/1989 | Lewis, Jr. | |
| 4,920,715 | A | | 5/1990 | Parsons et al. | |
| 4,980,984 | A | | 1/1991 | Kulp et al. | 40/610 |
| 5,060,437 | A | | 10/1991 | Parsons et al. | |
| 5,094,023 | A | | 3/1992 | McVey | 40/606 |
| 5,318,258 | A | | 6/1994 | Lang | |
| 5,340,068 | A | | 8/1994 | Sarkisian et al. | |
| 5,422,638 | A | | 6/1995 | Singer et al. | |
| 5,480,121 | A | * | 1/1996 | Rice et al. | 248/548 |
| 5,667,175 | A | | 9/1997 | Brady | |
| 5,794,910 | A | | 8/1998 | Granger | |
| 5,887,842 | A | | 3/1999 | Granger | |
| 5,931,724 | A | | 8/1999 | Perlov et al. | |
| 5,957,425 | A | | 9/1999 | Conway et al. | |
| 6,237,268 | B1 | * | 5/2001 | Levin | 40/606 |
| 6,315,251 | B1 | * | 11/2001 | Stoudt et al. | 40/608 X |
| 6,467,747 | B1 | * | 10/2002 | Ellsworth | 248/548 |
| 6,560,906 | B1 | | 5/2003 | Hillstrom | |

* cited by examiner

*Primary Examiner*—Joanne Silbermann
(74) *Attorney, Agent, or Firm*—Fitch, Even, Tabin & Flannery

(57) ABSTRACT

The invention provides a portable, collapsible sign stand assembly in which a sign is suspended from a support tube. The support tube is connected to a support base through a connecting member which includes a plurality of weakening members which cause the connecting member to fail upon impact.

11 Claims, 30 Drawing Sheets

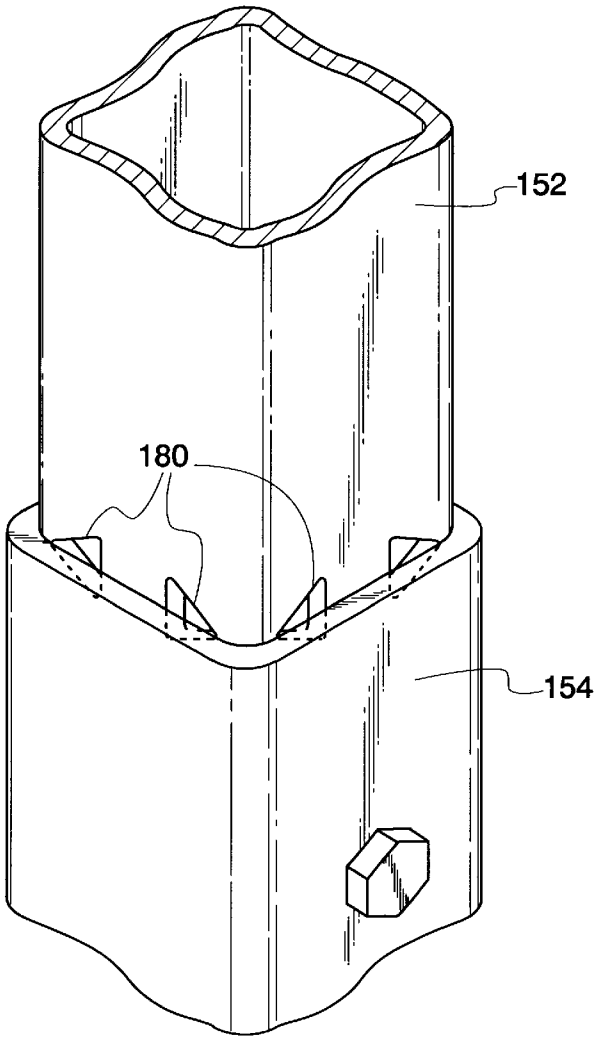
Fig. 27
Fig. 26
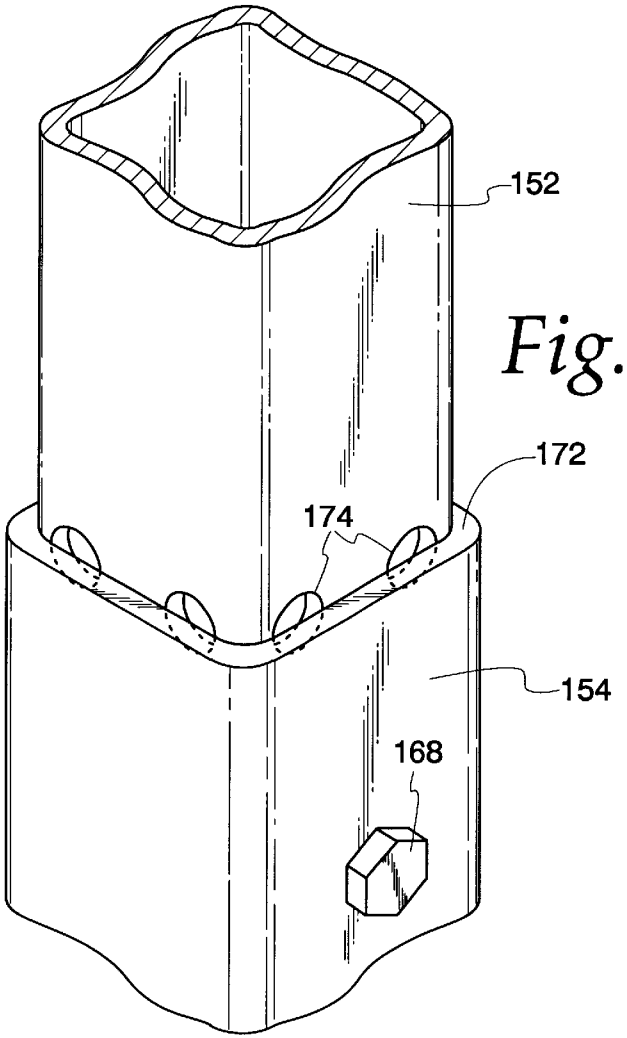

LIGHTWEIGHT COLLAPSIBLE SIGN

CROSS REFERENCE TO RELATED APPLICATIONS

This is a continuation-in-part, of prior application Ser. No. 09/798,681, filed Mar. 2, 2001, pending which is hereby incorporated herein by reference in its entirety.

BACKGROUND OF THE INVENTION

1. Field of the Invention

The present invention pertains to signs such as temporary warning signs which may be collapsed for storage in a reduced space and readily erected upon demand.

2. Description of Related Art

Warning signs are provided for a variety of purposes. Among the more demanding applications, is the use of roadside warning signs to advise motorists and pedestrians of activity being conducted at a work site. This type of signage allows those present in the vicinity to be alerted before entering the center of the work area so that appropriate action may be taken. Such signs are used, for example, by utility companies and others who maintain dedicated service in residential areas, and who may be required to perform repairs and other work activities in close proximity to pedestrian or vehicular traffic. With the presence of appropriate warning signs, pedestrian traffic is advised that objects unusual for the area may impede their progress of movement, that objects may be temporarily suspended above them or that other conditions may warrant careful scrutiny while traversing a work area. Vehicular traffic approaching a work site can, with sufficient amounts of properly located signage, be advised that traffic is being diverted or that traffic may be required to stop or slow down to avoid contact with workmen or construction vehicles, for example.

For long term projects, appropriate signage can be ordered ahead of time and installed in a permanent or semi-permanent fashion, after a detailed study of the particular work area. However, utility companies, highway departments, providers of emergency services and others may be required to establish a work area, virtually on a moment's notice. For example, management of a traffic accident scene may require appropriate signage to be erected in a traffic lane or at a roadside or other location, on an emergency basis. Bearing in mind that such signage must be large enough to present adequate notice to motorists and others passing by an area, consideration of the sign's size and weight must be taken into account when outfitting a work team. It is impractical in such instances to require work personnel to employ bulky, massive signage. Accordingly, lightweight so-called "roll-up" signs are becoming increasingly popular with a variety of different users. With lightweight collapsible signs, utility construction or repair crews can carry a number of such signs as standard equipment which is maintained in the vehicles at all times.

One example of a commercially popular collapsible sign panel is the Model No. 3000XP sign panels offered for sale by the assignee of the present invention. The collapsible sign panel employs aluminum tubing arms and a central mounting system which allows the panel to fold together before rolling into a compact bundle that is more easily stored in tight places. The sign panels are made of flexible retro-reflective material which is folded as the arms are pivoted about the hub. The flexible panel is then wound about the collapsed arms to form a compact, cylindrical package of minimal size. Sign panels which are as large as three feet and four feet on a side are typical.

U.S. Pat. No. 4,694,601 assigned to the assignee of the present invention shows a portable collapsible sign which has also enjoyed commercial success. Various sign stand assemblies employ spring loading features to balance wind deflection forces. Ground-engaging legs for supporting the erected sign panel may be permanently attached to the sign panel or may be provided in a separate assembly which is typically mated to the erected sign panel with a slip fit or other type of engagement.

With easily portable sign panel assemblies of the above-described type, the use of signage at temporary workplace locations is becoming more consistent due to the practicality and ease of use afforded worksite personnel. However, further improvements are still being sought. For example, continued improvements and simplifications of the sign assembly mechanisms are continually being sought.

The Transportation Research Board (TRB) is a unit of the National Research Council, a private, nonprofit institution that is the principal operating agency of the National Academy of Sciences (established by Congress in 1863) and the National Academy of Engineering. The mission of the Transportation Research Board is to promote innovation and progress in transportation by stimulating and conducting research, facilitating the dissemination of information, and encouraging the implementation of research results. The Transportation Research Board fulfills its mission through the work of its standing technical committees and task forces addressing all modes and aspects of transportation. Duties include conducting special studies on transportation policy issues at the request of the U.S. Congress and government agencies as well as operation of an on-line computerized file of transportation research information and the hosting of an annual meeting that attracts a large number of transportation professionals from throughout the United States and abroad. The Transportation Research Board administers two cooperative research programs: The first program, the National Cooperative Highway Research Program (NCHRP) is sponsored by the member departments of the American Association of State Highway and Transportation Officials in cooperation with the Federal Highway Administration, the National Cooperative Highway Research Program and the Transit Cooperative Research Program. The National Cooperative Highway Research Program was created in 1962 as a means of conducting research in acute problem areas that affect highway planning, design, construction, operation, and maintenance nationwide.

The second program, named the Transit Cooperative Research Program (TCRP), is sponsored by the Federal Transit Administration and is carried out under a three-way agreement among the National Academy of Sciences (acting through the Transportation Research Board), the Transit Development Corporation, Inc. (a nonprofit educational and research organization established by the American Public Transportation Association) and the Federal Transit Administration. The Transit Cooperative Research Program serves as one of the principal means by which the transit industry can develop innovative near-term solutions to meet demands placed on public transit systems.

Currently, developers of roadside safety hardware are guided by testing requirements using a range of criteria defined by Report 350 of the National Cooperative Highway Research Program (NCHRP), entitled "Recommended Procedures for the Safety Performance Evaluation of Highway Features." NCHRP Report 350, incorporated significant changes and additions to procedures for safety performance evaluation, including criteria for multiple performance levels, guidelines for testing features not previously addressed, translation to metric units, and updates reflecting the changing character of the highway network and the vehicles using it.

Concerns have been raised that some existing hardware, which is observed to be performing adequately in the field, may have difficulty passing new tests and evaluation criteria. Further study and testing has been called for in an attempt to improve roadside safety by establishing crashworthiness criteria that reflects changes to the vehicle fleet and safety hardware technology.

In its Jul. 25, 1997, guidance memo, "Identifying Acceptable Highway Safety Features," the Federal Highway Administration established four categories of work zone devices. It also set deadlines requiring devices within each category to be crashworthy under the National Cooperative Highway Research Program Report 350 criteria.

Work crews, such as those servicing and installing utility equipment, are required to operate at or near operational highways and other roadways. Temporary sign assemblies are typically carried by the work crew and are installed at a roadside location so as to give oncoming motorists time to react to the unexpected appearance of equipment and personnel, at or near the highway roadside. At times, a work crew's operation will be very brief. Nonetheless, it is important that roadside warnings in accordance with recent safety regulations, be set up in advance of work commencement. To be commercially successful, a temporary sign assembly must be capable of quick and easy deployment.

SUMMARY OF THE INVENTION

It is an object of the present invention to develop temporary sign assemblies that are good candidates for offering a satisfactory performance when tested under various safety programs.

It is another object of the present invention to provide sign panel assemblies having an improved ease of operation, with low mass, conformable, dynamically reconfigurable members.

A further object of the present invention is to make it possible for police vehicles, survey teams and others which typically employ automobile and other similar sized vehicles to carry several signs in the trunks of their vehicles.

These and other objects of the present invention are provided in a support arrangement, a base, a force accumulator tube of hollow predetermined cross-section outwardly extends from the base and has a free edge spaced from the base. A support tube of hollow complementary cross-section telescopically engages in a close-sized fit with force accumulator tube so as to have a predetermined portion which extends beyond the free edge of force accumulator tube. An insertion limiter cooperates with force accumulator tube and support tube to limit telescopic engagement of support tube and force accumulator tube, aligns with predetermined portion with the free edge of force accumulator tube, and predetermined portion of support tube includes a plurality of weakening members aligned with the free edge of force accumulator tube. A lateral force applied to sign support arrangement is accumulated at free edge of force accumulator tube and is developed at predetermined portion of support tube.

Other objects are attained in a support arrangement, a base plate, a force accumulator tube of hollow predetermined cross-section depends from base plate, force accumulator having a free edge spaced from the base plate, support tube of hollow complementary cross-section, has a lower edge. A support plate at the bottom of support tube, support plate spaced from base plate to form a gap therewith. A tension arrangement extends between base plate and support plate, urging said base plate and support plate away from one another, a connecting tube having opposed ends telescopically engaged in a close-sized fit with force accumulator tube and support tube, and spanning the gap between support plate and base plate first and second insertion limiters cooperating with force accumulator tube, connecting tube and support tube to limit telescopic engagement of connecting tube and force accumulator tube limiting telescopic engagement of support tube and force accumulator tube, aligning a predetermined portion of connecting tube with a force accumulator tube free edge, and predetermined portion of connecting tube including a plurality of weakening members aligned with the free edge of force accumulator tube. A lateral force applied to sign support arrangement is accumulated at the free edge of force accumulator tube and is developed at predetermined portion of connecting tube.

BRIEF DESCRIPTION OF THE DRAWINGS

FIG. 26 shows a portion of the sign stand assembly of FIG. 24, taken on an enlarged scale;

FIGS. 27 and 28 show fragmentary views of alternative embodiments of the sign stand assembly of FIG. 24;

DETAILED DESCRIPTION OF THE PREFERRED EMBODIMENTS

Figure 1:
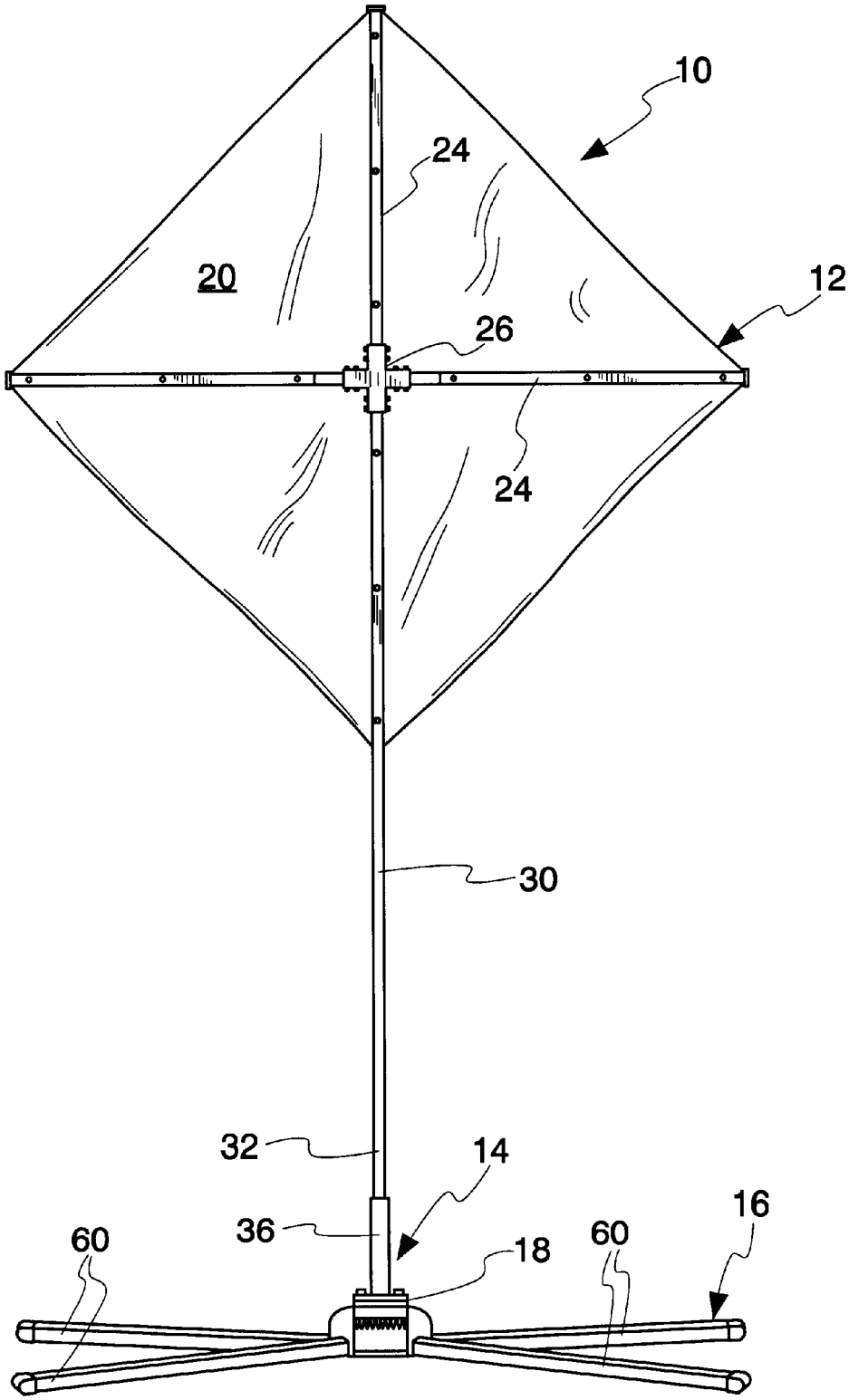
FIG. 1 is a perspective view of a sign and sign stand assembly according to principles of the present invention.

Turning now to the drawings, FIG. 1 shows a sign apparatus generally indicated at 10. Included is a sign panel assembly 12 supported by a sign stand assembly 14 having ground-engaging legs 16 and a spring-loaded pivoting coupling 18. The sign panel assembly 12 includes a flexible message or sign panel 20 of conventional construction. Sign panel 20 may, for example, comprise a mesh fabric such as vinyl coated polyester mesh or may be of a solid or continuous such as a vinyl coating applied to a polyester fabric backing. It is generally preferred that the sign panel 20 be made of some sort of reflective material, such as a vinyl microprism reflective material so as to provide a high level of retro-reflectivity of a type suitable for traffic applications.

Federally mandated standards are being developed to ensure that roadside appurtenances such as temporary warning signs are crashworthy under the National Cooperative Highway Research Program Report 350 criteria. Category II Devices are defined as not being expected to produce significant vehicular velocity change, but may otherwise be hazardous. The following is a SUMMARY OF SUPPLEMENTARY EVALUATION FACTORS for crash worthiness according to the National Cooperative Highway Research Program Report 350 criteria:

Passenger Compartment Intrusion

1. Windshield Intrusion
   a. No windshield contact
   b. Windshield contact, no damage
   c. Windshield contact, no intrusion
   d. Device embedded in windshield, no significant intrusion
   e. Partial intrusion into passenger compartment
   f. Complete intrusion into passenger compartment
2. Body Panel Intrusion (yes or no)

Loss of Vehicle Control

1. Physical loss of control
2. Loss of windshield visibility
3. Perceived threat to other vehicles from debris
4. Debris on pavement Physical Threat to Workers or Other Vehicles 1. Harmful debris that could injure workers (yes or no)
2. Harmful debris that could injure workers in other vehicles (yes or no)

If yes, record the size and approximate mass of the debris, the approximate speed (high or low) and the approximate trajectory (height, direction etc.) of the potentially harmful debris.

Vehicle and Device Condition

1. Vehicle Damage
   a. None
   b. Minor scrapes, scratches or dents
   c. Significant cosmetic dents
   d. Major dents to grill and body panels
   e. Major structural damage
2. Windshield Damage
   a. None
   b. Minor chip or crack
   c. Broken, no interference with visibility
   d. Broken and shattered, visibility restricted but remained intact
   e. Shattered, remained intact but partially dislodged
   f. Large portion removed
   g. Completely removed
3. Device Damage
   a. None
   b. Superficial
   c. Substantial, but can be straightened
   d. Substantial, replacement parts needed for repair
   e. Cannot be repaired FIG. 1 shows a sign panel 20 in a deployed or fully expanded configuration. Two or more arm assemblies 24 span the corners of panel 20 to hold the panel in a preferred planar configuration. The arm assemblies may comprise a pair of rigid aluminum ribs, or alternatively a pair of fiberglass ribs, as is known in the art. Other types of materials may also be employed as well. As an alternative, the arm assemblies may be formed separate one from another and joined at the center to align the arms in a coplanar arrangement, so as to provide a suitable support surface for the flexible panel 20. A central hub assembly is indicated at 26. Together, the arm assemblies 24 and center hub assembly 26 comprise a panel supporting system, which, together with the sign panel 20 comprise panel assembly 12. With the sign panel assembly in a fully opened position, panel 20 is maintained relatively taut, and is thus subject to naturally occurring or vehicle induced wind bursts. These forces are applied to a support tube or upright 30. If desired, one or more arms 24 can span the vertical extent of panel 20, with support tube 30 being coupled to the arm at a point adjacent the bottom of panel 20. Alternatively, support tube 30 may be extended to the top of panel 20, with its upper portion functioning as the vertical support arm(s) 24.

A bottom portion 32 of support tube or upright 30 is fitted to a sign stand assembly 14. With additional reference to FIG. 2, sign stand assembly 14 includes a support tube 36 which is joined to an upright 30 to impart support thereto Support tube 36 is hollow, with a central passageway dimensioned to receive the bottom portion of upright 30. The upright 30 is secured within the upper portion of support tube 36 by bolt fasteners 38. Alternative constructions, may include an upright 30 which is telescopically received within support tube 36 and secured thereto with suitable adhesives or metallurgical joining such as welding or brazing. Alternatively, support tube 36 can be made to comprise the bottom portion of upright 30, eliminating the need for a special joining arrangement.

Figure 2:
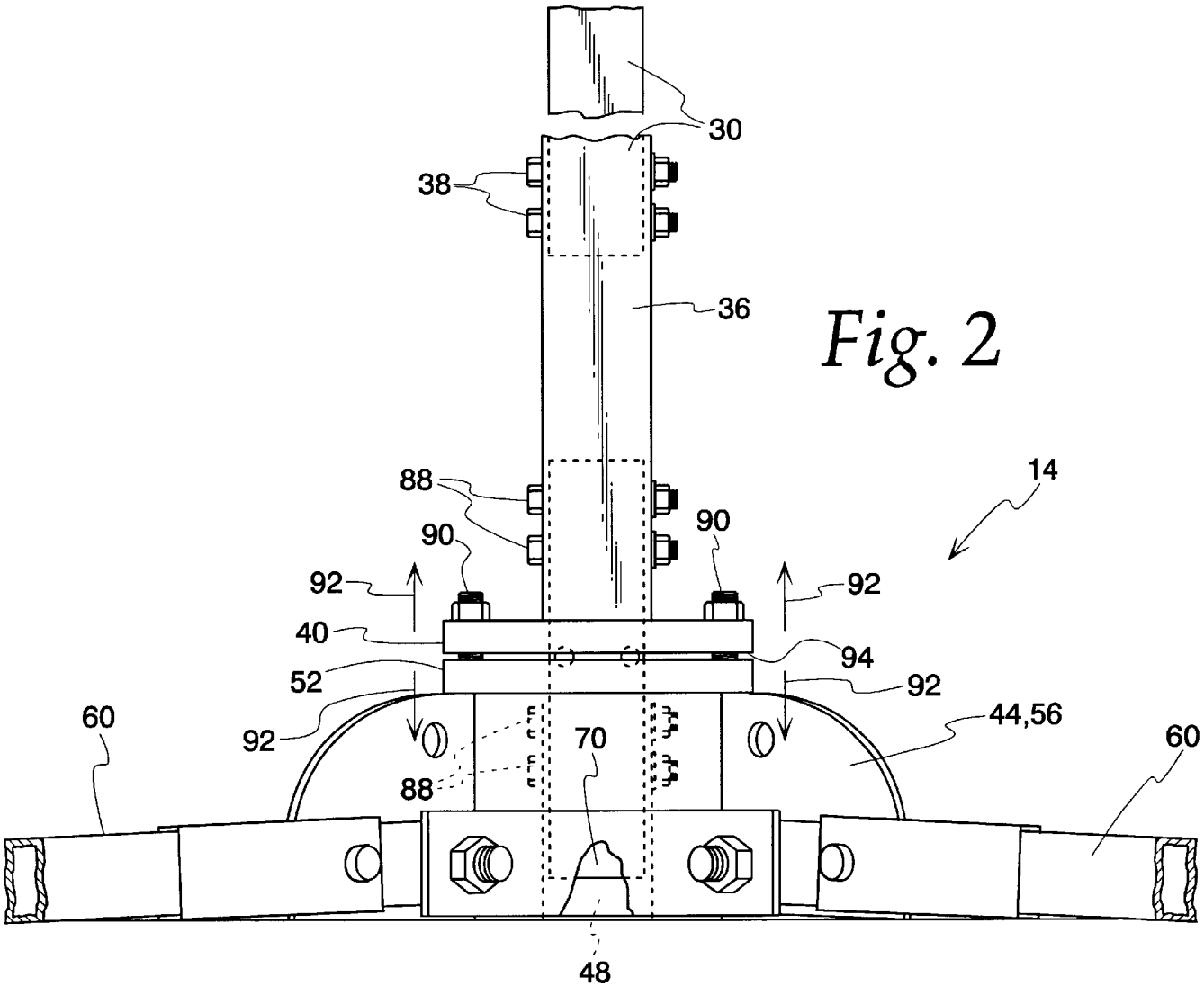
FIG. 2 is a fragmentary front elevational view of the sign stand assembly, taken on an enlarged scale.
Figure 3:
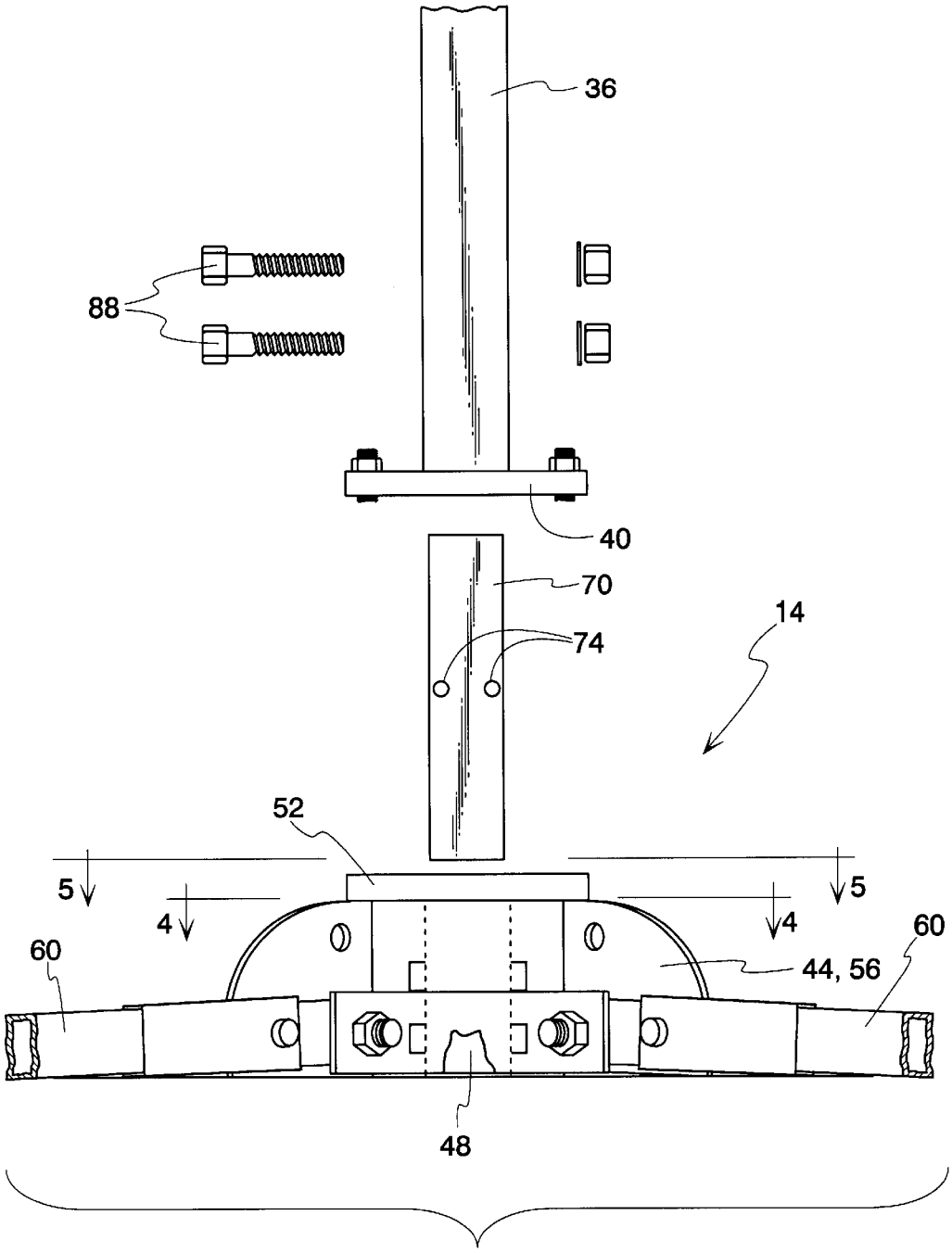
FIG. 3 is an exploded view thereof.

With reference to FIGS. 1–3 support tube 36 is joined to support plate 40. Preferably, support tube 36 is fitted within an aperture formed in plate 40, with the bottom edge of support tube 36 located adjacent the bottom major surface of support plate 40. Support tube 36 is joined to support plate 40 using conventional fastening means such as adhesive, shrink fit, brazing and most preferably welding. Together, support tube 36 and support plate 40 form a continuous rigid structure.

Figure 5:
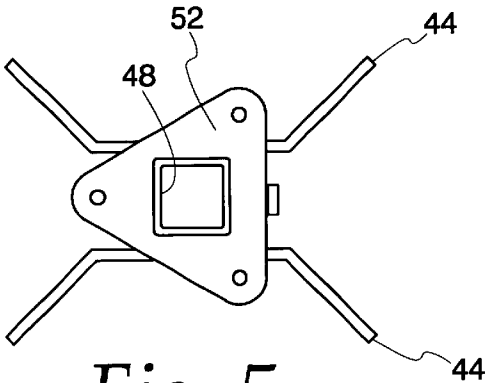
FIG. 5 is a cross-sectional view taken along the line 5—5 of FIG. 3.

Referring now to FIGS. 2–5, support assembly 14 includes a pair of opposed body plates 44 joined to an intermediate force accumulator tube 48. Preferably, force accumulator tube is hollow and is joined to body plates 44 using conventional means, such as welding. An optional outer support collar 46 may be employed to assist in the welding operations. For example, collar 46 may be welded between plates 44 with force accumulator tube 48 thereafter being welded to support collar 46. With reference to FIG. 5, force accumulator tube 48 is fitted within a base plate 52 and has an upper end preferably aligned adjacent the upper major surface of base plate 52. Force accumulator tube 48 and base plate 52 are joined together using conventional fastening means, such as welding. The base plate 52 is also joined to bottom plates 44 preferably by welding. Accordingly, base plate 52, force accumulator tube 48 and plates 44 comprise a unitary rigid assembly.

As indicated in FIGS. 2 and 3, plates 44 include outwardly diverging ears 56 each of which supports a ground-engaging leg 60 (see FIG. 1). Legs 60 have been omitted in FIGS. 4 and 5 for drawing clarity. A connecting tube 70 has an upper end inserted within support tube 36 and a lower end inserted within force accumulator tube 48. As can be seen in FIG. 3 the mid-portion of connecting tube 70 includes several weakening members 74 which are aligned in a plane generally perpendicular to the longitudinal axis of a connecting tube. The connecting tube, as with the support tube and force accumulator tube, have generally rectangular and most preferably square cross-sectional shapes. Connecting tube 70 has upper and lower portions dimensioned for a relatively close fit engagement with the support tube and force accumulator tubes, respectively.

Figure 8:
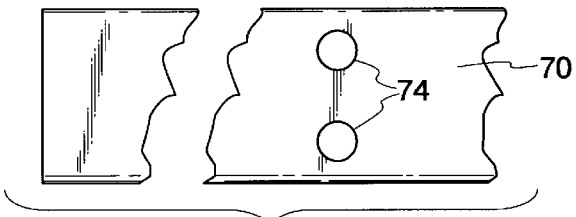

Accordingly, the connector tube 70 has four outer faces, one of which is visible, for example, in FIG. 3. Preferably, all four outer faces of connecting tube 70 have an identical appearance, that is, each face has a pair of weakening members 74. As illustrated in FIG. 3 and as can be seen in the enlarged drawings of FIGS. 8 and 11, weakening members 74 comprise round holes located toward the outside corners of the connecting tube, and being separated by an intervening wall portion of the connecting tube.

Figure 11:
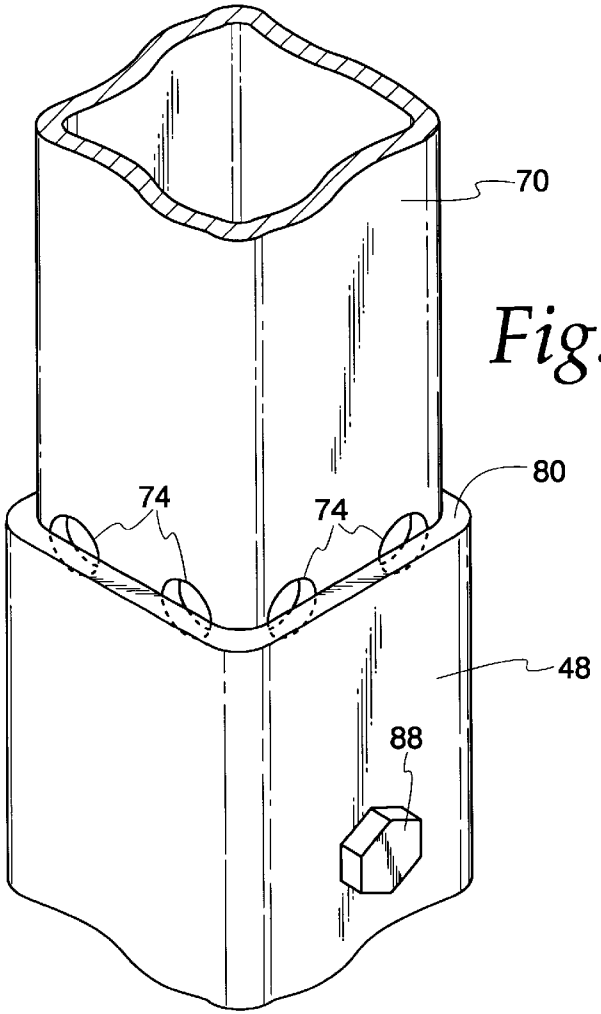
Figure 12:
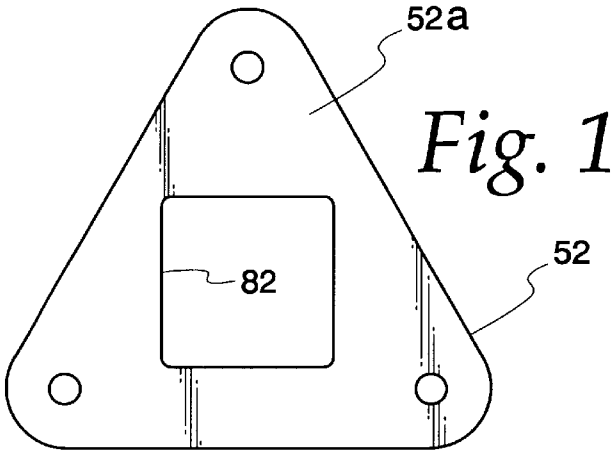

Referring again to FIG. 11, force accumulator tube 48 has an upper end surface 80 which, as mentioned, is generally aligned with the upper major surface of base plate 52. With reference to FIG. 12, base plate 52 has a central opening 82 for receiving the upper end of force accumulator tube 48. Preferably, opening 82 is dimensioned for a close tolerance fit with the upper end of the force accumulator tube. Preferably, the force accumulator tube 48 is rigidly joined to base plate 52 with a conventional joining means such as welding to maintain the upper edge 80 (see FIG. 11) of the force accumulator tube 48 with the upper surface 52*a* of base plate 52 (see FIG. 12). As shown in FIG. 11, connecting tube 70 is carefully aligned with respect to force accumulator tube 48, with a controlled insertion depth, such that the upper edge 80 of the force accumulator tube generally overlies only the lower half portions of weakening member 74. FIG. 11 shows the preferred relative alignment of the force accumulator and connecting tubes, although the relative alignment can be made to vary plus or minus one-half the vertical height of the weakening element as may be desired to "fine-tune" the desired response for a particular installation.

With reference to FIG. 2, the upper and lower ends of connecting tube 70 are secured to support tube 36 and force accumulator tube 48, respectively by bolt-like fasteners 88. A plurality of threaded fasteners 90 extend between plates 40, 52 and are arranged, so as to apply a force tending to separate plates 40, 52 in the direction of arrows 92. Although not required, it is generally preferred that a gap 94 be formed between plates 40, 52. Threaded fasteners 90 are threadingly engaged with support plate 40 and have lower ends receiving thrust support from the upper surface of base plate 52. As threaded fasteners 90 are advanced, support plate 40 is urged in an upward direction, away form base plate 52. Upward travel is restrained by connecting tube 70 which is joined at its upper and lower ends to the support tube 36 and force accumulator tube 48, respectively.

Figure 16:
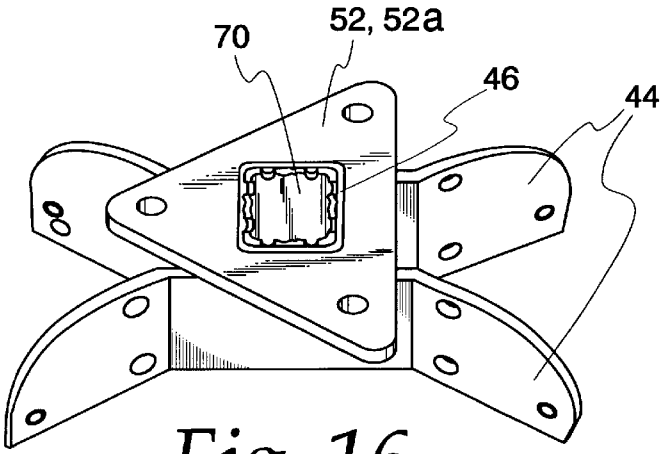
Figure 21:
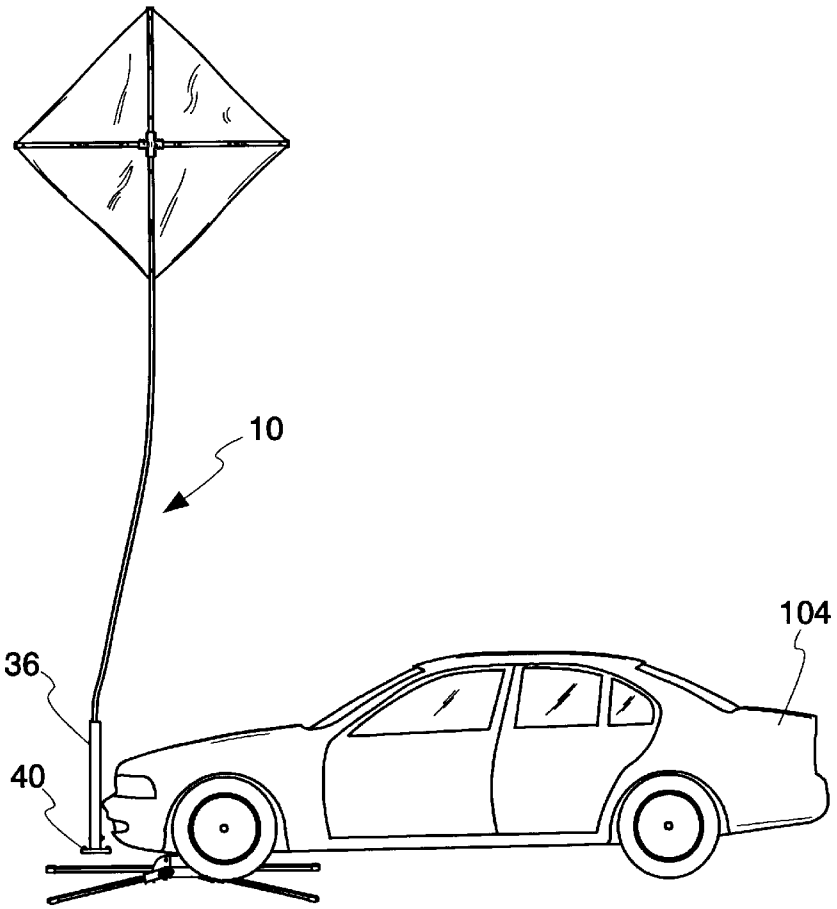
FIGS. 20–22 show the sign stand assembly during an impact event.
Figure 20:
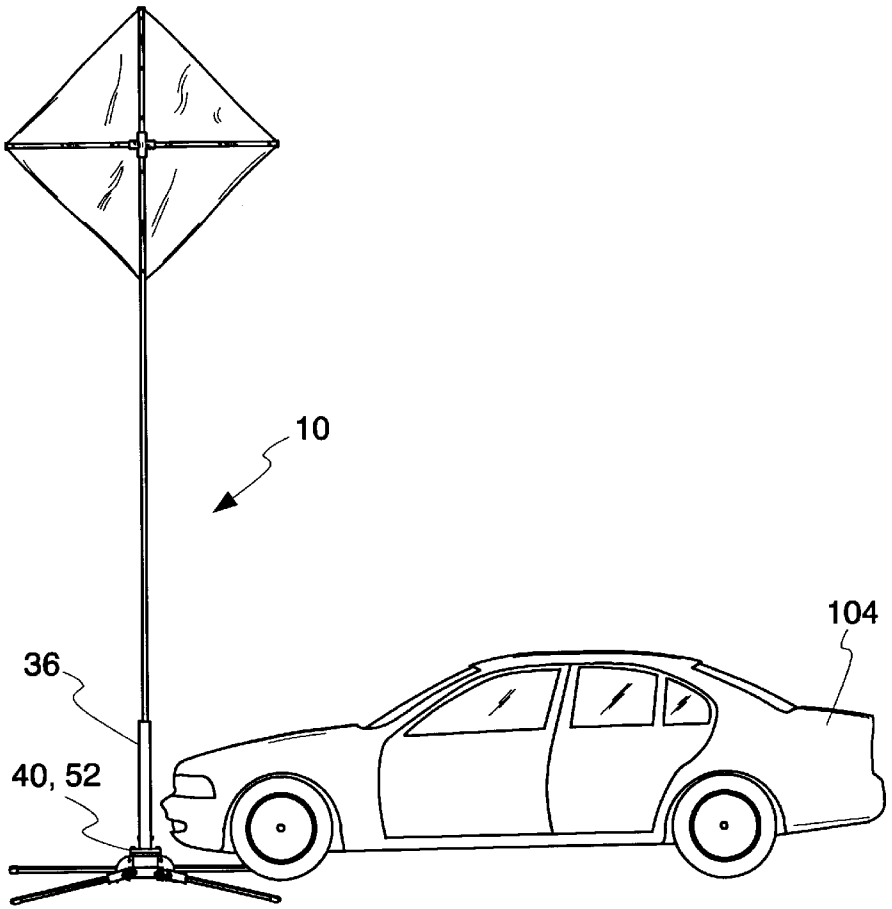
Figure 22:
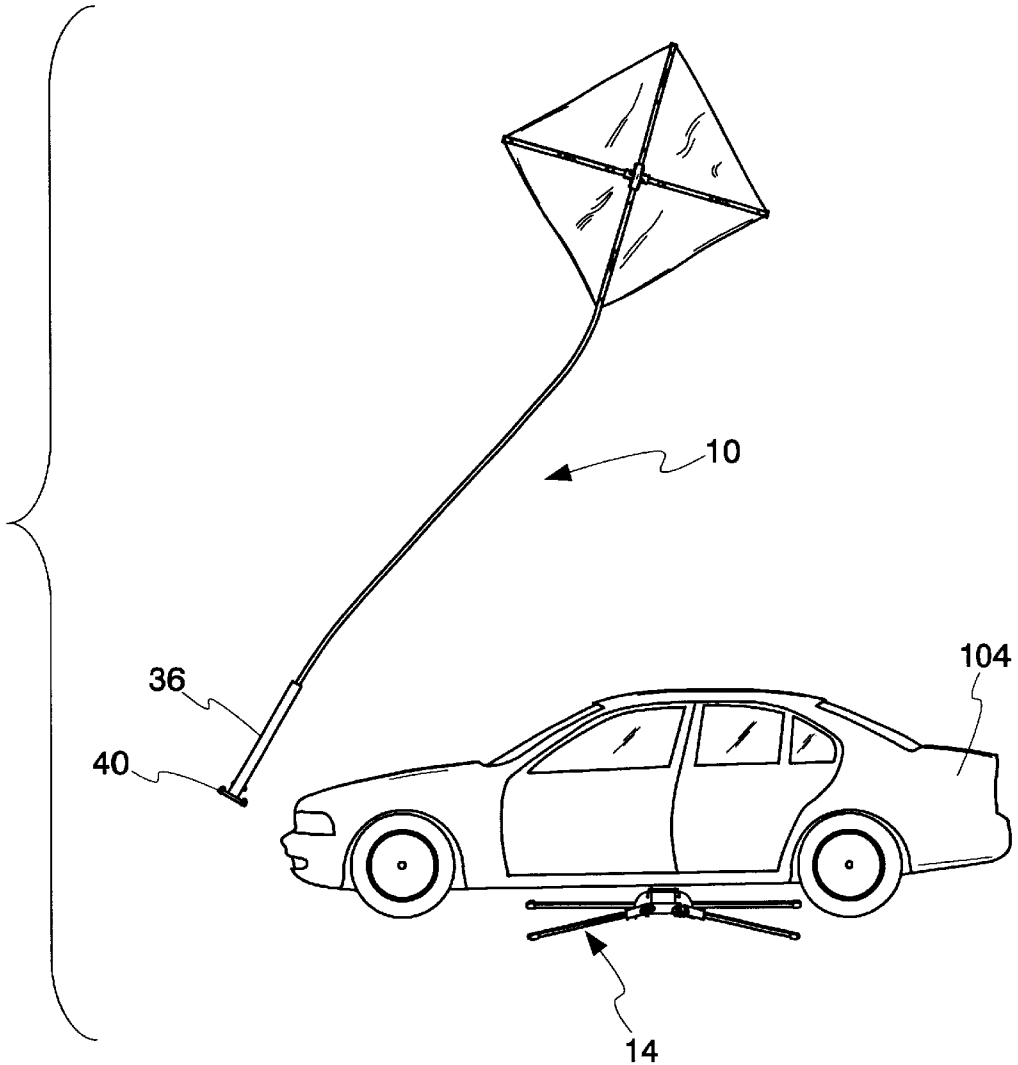
Figure 23:
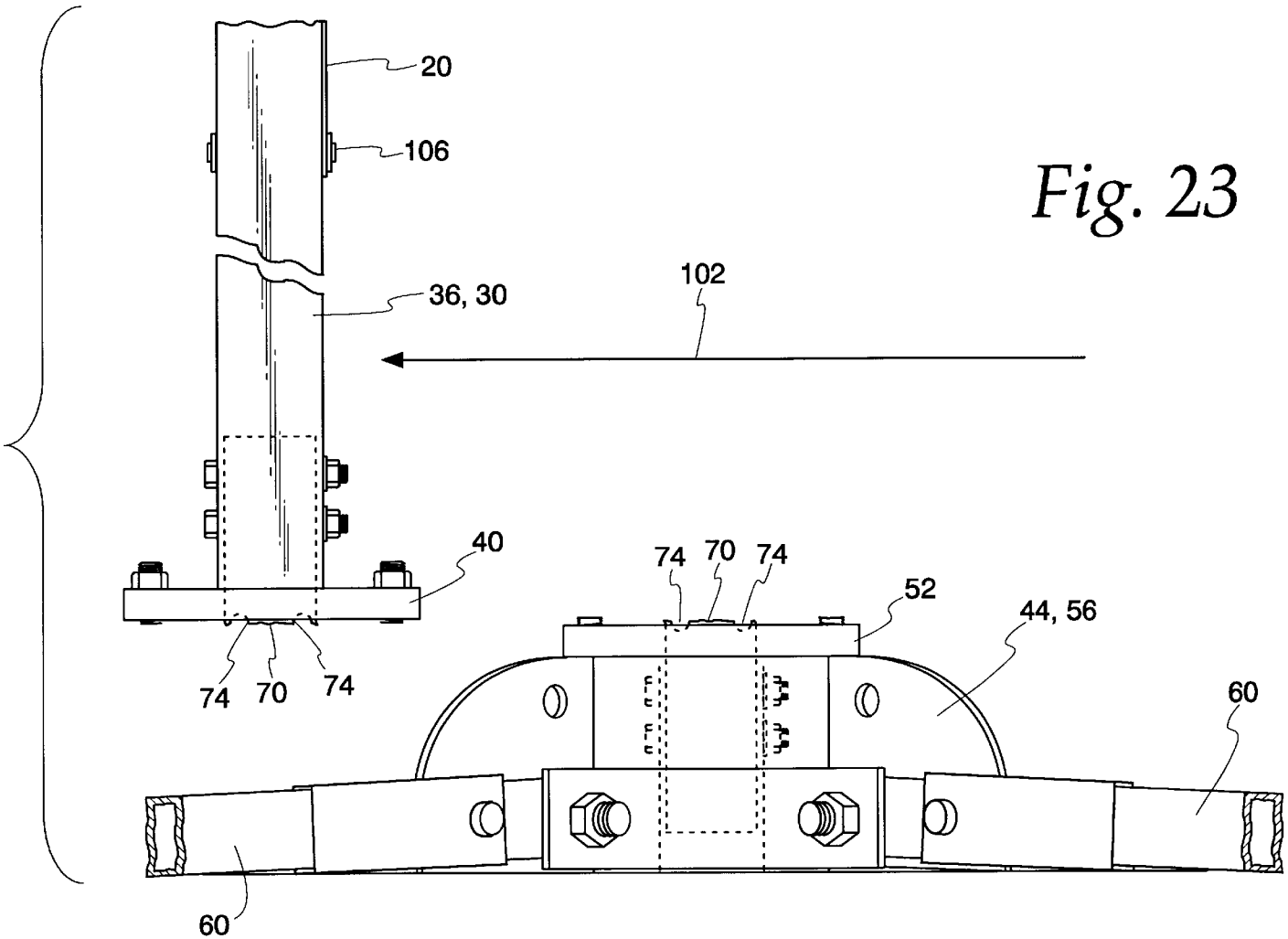
FIG. 23 is an enlarged fragmentary view of the sign stand assembly immediately after impact.

Threaded fasteners 90 are advanced until a predetermined tension load is placed on connecting tube 70. When subjected to an impact event as indicated by FIGS. 20–22, connecting tube 70 is ruptured in the manner indicated in FIGS. 16 and 23. The connecting tube has been observed to separate along an imaginary, generally horizontal plane located at or slightly above the upper surface of base plate 52. In FIG. 23, the direction of applied force is indicated by arrow 102 and, in the impact scenario indicated in FIGS. 20–23 it is aligned with the direction of travel of the illustrated vehicle 104. The sign assembly 10 illustrated in FIGS. 20–23 has a support tube 36 extending up to and at least slightly above the point of impact with vehicle 104, causing efficient transfer of lateral force to the region of weakening of connecting tube 70, defined by weakening member 74 and located generally in gap 94, at or between the opposed major faces of plates 40, 52. If desired, the support tube 36 and upright 30 of the sign panel assemblies can comprise a continuous unitary member. As indicated in FIG. 23, panel 20 is secured by a conventional rivet fastener 106.

Tensioning of the connecting member 70 is believed to greatly enhance energy control or focusing during the impact event. The relatively clean planar rupturing of the connecting member at or slightly above the upper surface of the base plate was observed even with ground engaging legs which are unrestrained and free to travel in a sideways direction, for example. Without the invention herein, as the sign stand travels in a lateral direction, the base rocks or twists altering modes of energy absorption during the critical initial portion of the impact event, which typically occurs in less than a second. It is important during this critical time in the impact event that impact forces are efficiently transferred into the sign stand, and transferred in an advantageous manner which causes the sign stand to rupture with the upper end of the sign stand directed along a path of movement which clears the vehicle windshield. Such important features are provided by the present invention. As indicated in FIG. 22, the support plate 40 has achieved a height generally aligned with the vehicle hood with the upper, freed portion of the sign stand accelerating in an upward direction while rotating in a clockwise direction, timed so as to bring the support plate 40 and support tube 46 above the path of travel of the vehicle windshield. In fact, as has been observed that with the present invention, the entire freed portion of the sign stand reacts to the applied impact force in a manner so as to clear vehicle 104 without making contact with the vehicle during or after the impact event.

Figure 6:
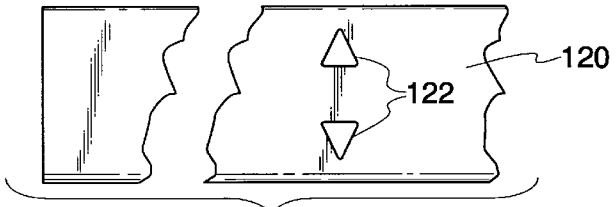
FIGS. 6–8 are fragmentary elevational views showing a connecting tube portion of the sign stand assembly.
Figure 9:
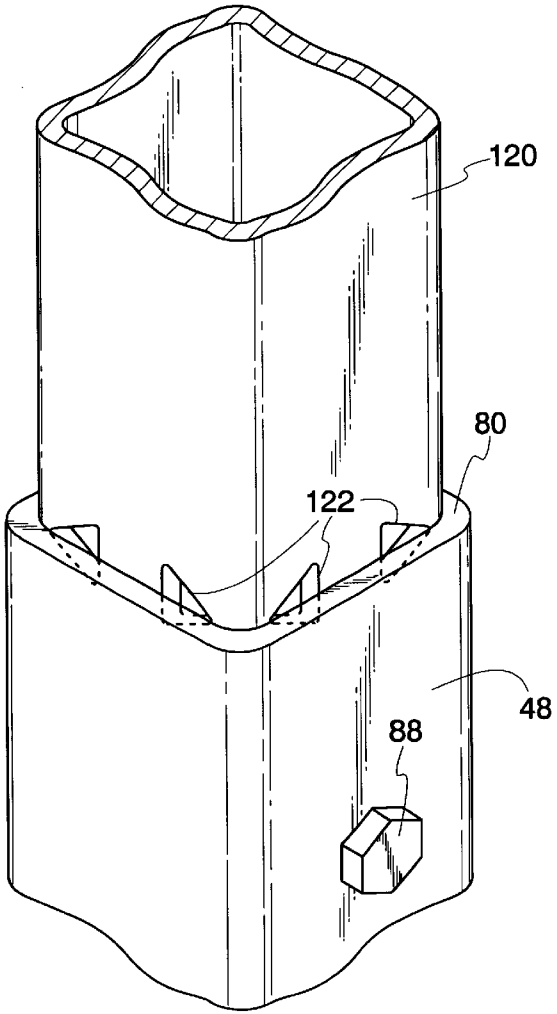

Referring now to FIGS. 6 and 9, an alternative connecting tube is indicated at 120. Connecting tube 120 is substantially identical to the connecting tube 70 described above, except that weakening members 122 have a generally triangular shape. As indicated, the triangular openings 122 are aligned along a common plane, generally transverse to the longitudinal axis of connecting tube 120. Triangular openings 122 on a given face of the connecting tube point away from each other, toward outside corners of the connecting tube. As shown in FIG. 9, the upper edge 80 of force accumulator tube 48 is aligned with respect to weakening members 122 such that generally only the lower half of the weakening members is overlaid by force accumulator tube 48. In this and other arrangements, relative orientation of the force accumulator tube and the connecting tube may be adjusted generally plus minus one-half the vertical height of the weakening members.

Figure 7:
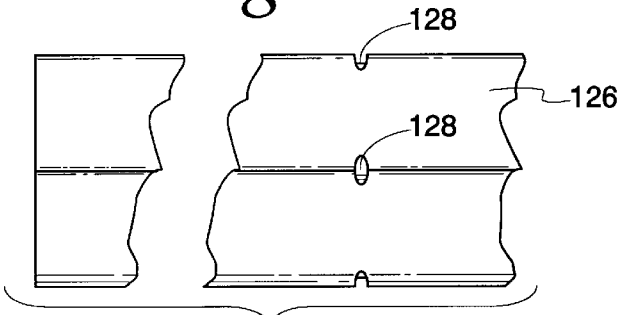
Figure 10:
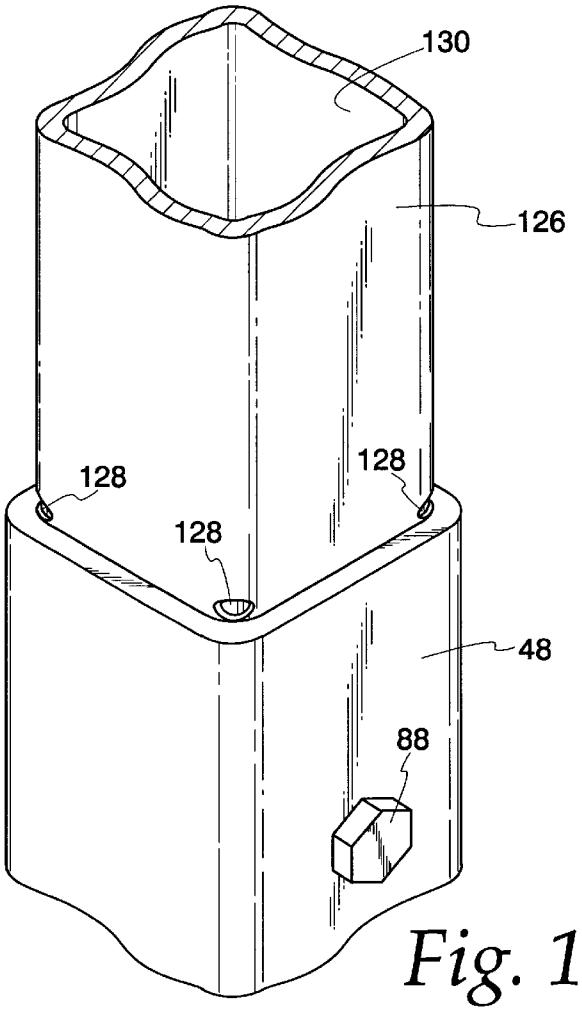
FIGS. 9–11 are fragmentary perspective views showing the connecting tubes to FIGS. 6–8 installed in a sign stand assembly.

With reference to FIGS. 7 and 10, connecting tube 126 has outside corners in which weakening members 128 are formed. Weakening members 128 generally comprise notches extending into the outside corners and are preferably aligned along a common plane generally perpendicular to the longitudinal axis of the connecting tube. Notches 128 extend below the outer surface of the connecting tube and most preferably extend through the walls of the hollow connecting tube penetrating the inner surface 130 (see FIG. 10).

Figure 13:
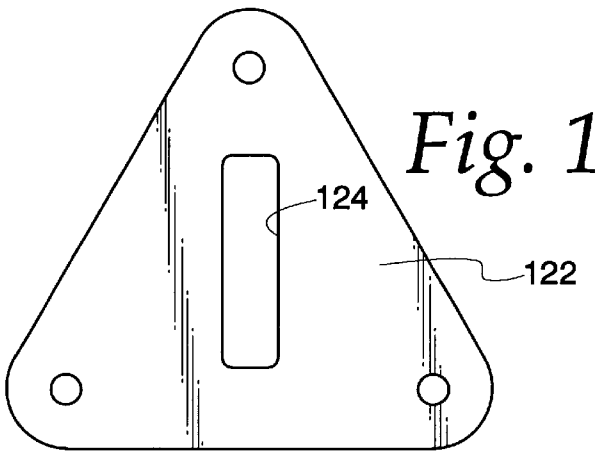
FIGS. 12–15 show alternative embodiments of base plate members of the sign stand assembly.
Figure 17:
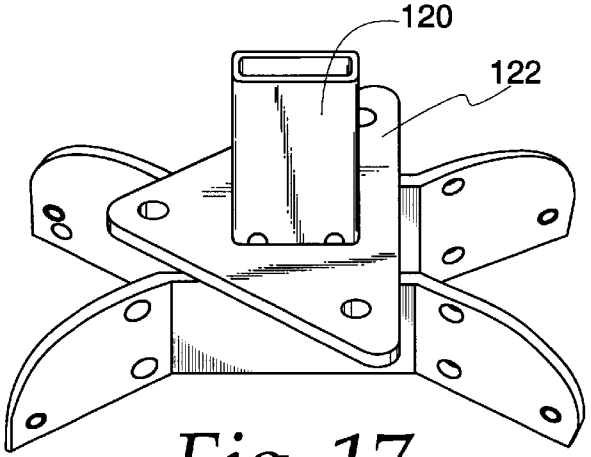
FIGS. 16–19 show the base plates of FIGS. 12–15 installed in a sign stand assembly.

Referring to FIGS. 13 and 17, the connecting tube indicated at 120 has an elongated, rectangular, cross-sectional shape. Connecting tube 120 is received in a base plate 122 having an elongated rectangular opening 124 dimensioned for a tight fit with the connecting tube. Any of the weakening members described above may be employed. As a further example of optional weakening which may be employed with any of the arrangements herein, one or more "score" lines may extend into the surface of the connecting tube, preferably along a plane generally perpendicular to the longitudinal axis of the connecting tube. The "score" lines may be continuous or may be spaced-apart so as to resemble a "dashed" line.

Figure 14:
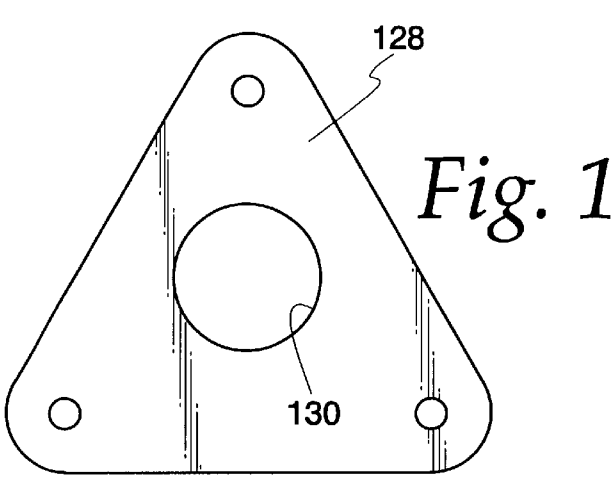
Figure 18:
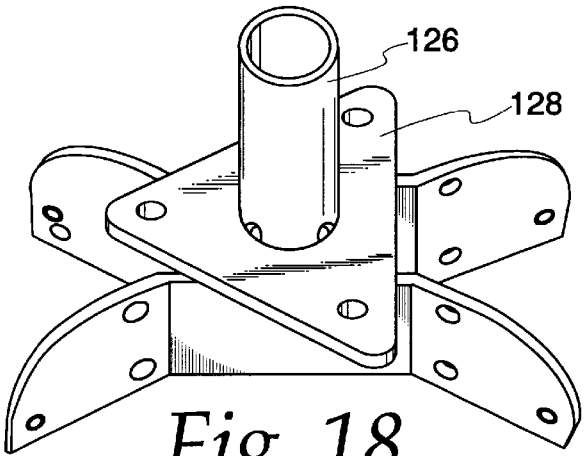

As shown in FIGS. 18 and 14 the connecting tube may have a generally cylindrical configuration as indicated at 126. The corresponding base plate 128 has a circular hole 130 to receive connecting tube 126 in a tight fit relationship.

Figure 15:
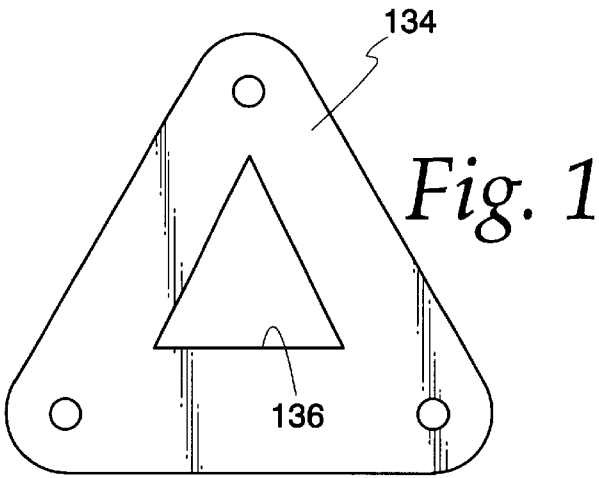
Figure 19:
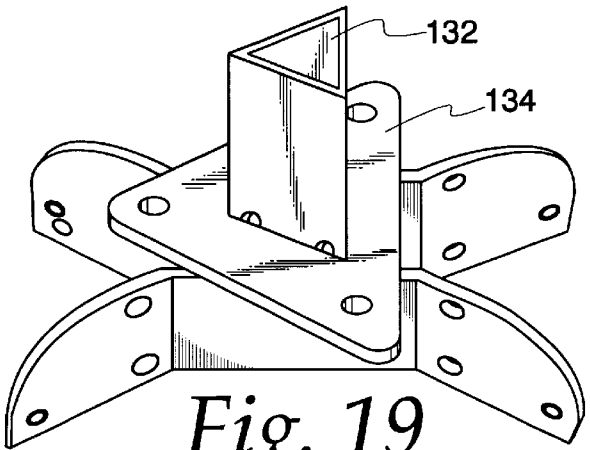

FIGS. 15 and 19 show an arrangement for a connecting tube having a generally triangular cross-section, as indicated at 132. A connecting tube is received in a triangular opening 136 formed in base plate 134 and is dimensioned for a telescopic fit with the connecting tube in a tight fit relationship. Any of the weakening members described herein may be employed with the alternative connecting tubes and their associated plates.

Figure 25:
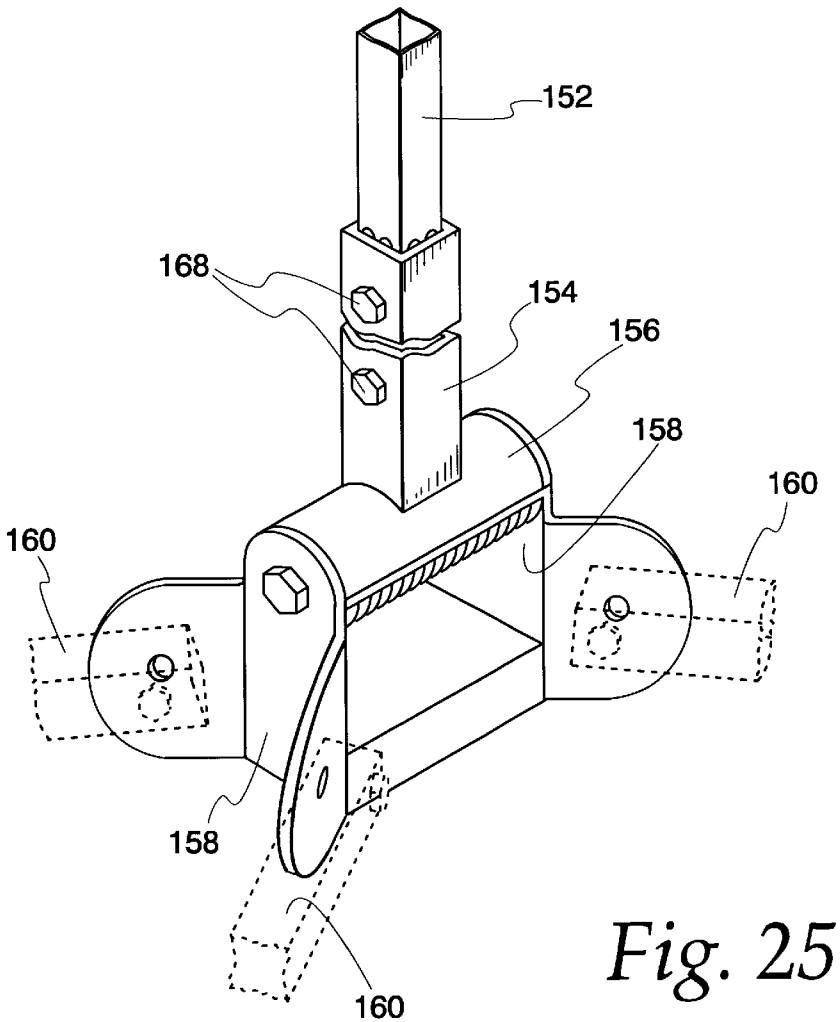
FIG. 25 is a fragmentary perspective view of a sign stand support of FIG. 24.
Figure 4:
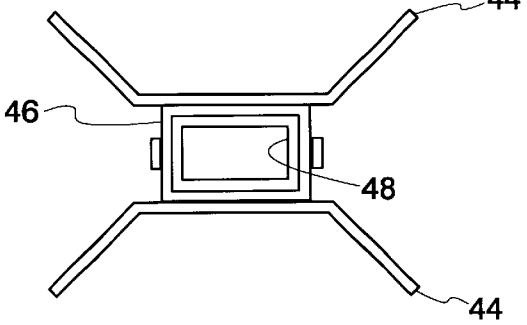
FIG. 4 is a cross-sectional view taken along the line 4—4 of FIG. 3.
Figure 24:
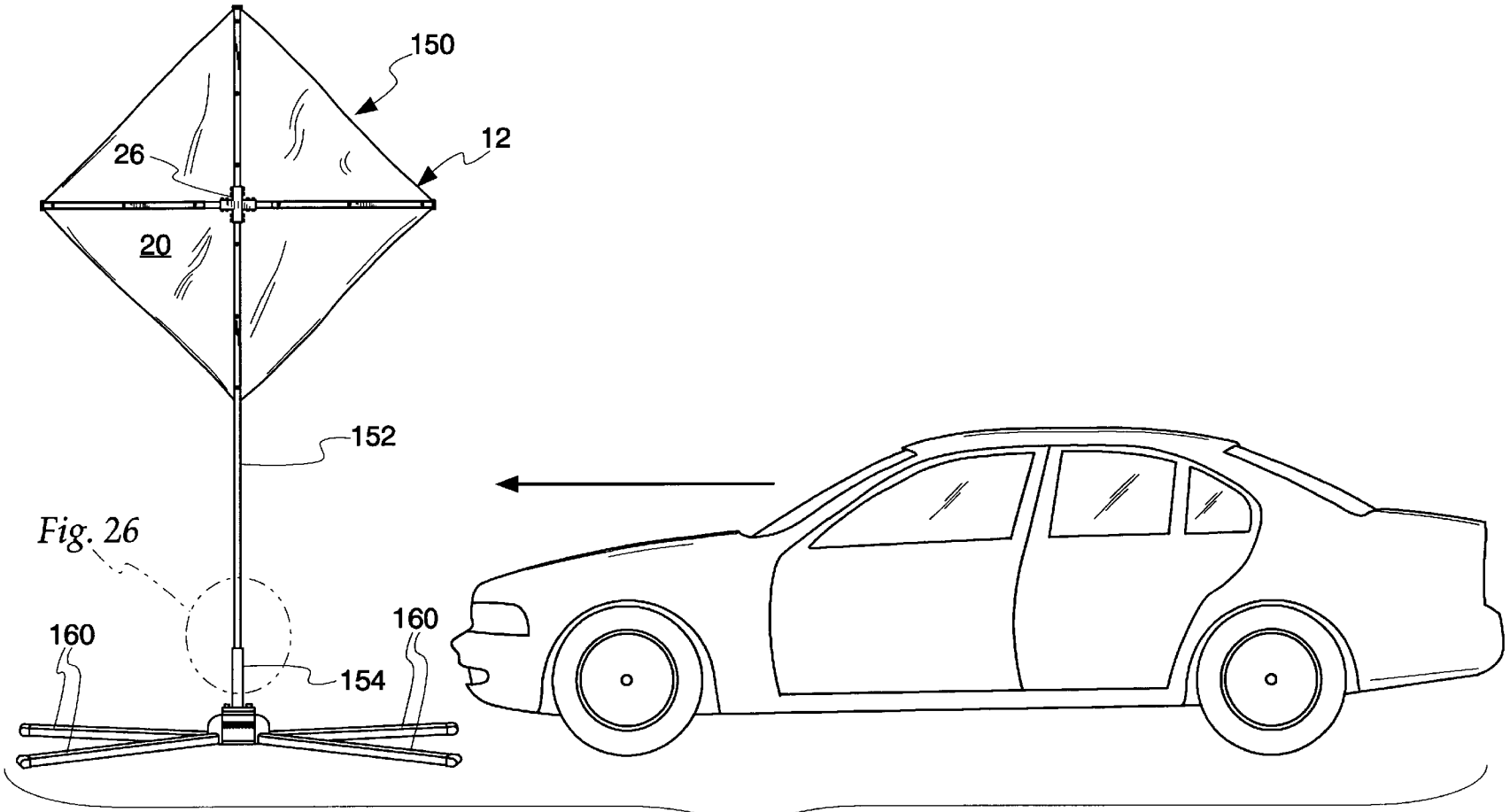
FIG. 24 shows an alternative embodiment of a sign stand assembly and sign stand, immediately prior to an impact event.

Turning now to FIGS. 24 and 25, an alternative sign arrangement is generally indicated at 150. Included is a sign panel assembly generally indicated at 12, as described above and an upright or support mast 152 received in a force accumulator tube 154. As can be seen with reference to FIG. 25, force accumulator tube 154 is supported on an upper saddle member 156 of a conventional spring-loaded sign supporting base of a type known in the art. Force accumulator tube 154 is preferably welded or otherwise rigidly joined to saddle member 156. The sign support base includes side plates 158 supporting ground engaging legs 160. If desired, force accumulator tube 154 can receive support in conventional ways other than the base having ground engaging legs. For example, a conventional ground socket can be provided for telescopic mating with the force accumulator tube, or the force accumulator tube itself, could be used as a ground socket. Further, provision can be made in timbers, concrete pads, steel plates or other conventional expedients to support force accumulator tube 154 in a generally upright direction. Again, if desired, direct connection can be made to the force accumulator tube or a mounting socket for receiving the accumulator tube can be provided.

The force accumulator tube 154 may be resiliently mounted with respect to the sign support base so as to absorb wind energy in a conventional manner. Such torsional mountings have been employed to prevent wind bursts from causing the sign assembly to tip over or "hop" along the ground surface. The torsional mounting may be omitted, if desired.

The upright mast or support tube 152 may extend to the top of message panel 20 or may be coupled to vertical rib members at the central hub 26 or at some point therebelow, such as adjacent the bottom of sign panel 20. Upright 152 is telescopically inserted within force accumulator tube 154, in the manner described above with respect to the aforementioned connecting tubes. The depth of insertion of upright 152 within force accumulator tube 154 is limited by threaded fasteners 168. With additional reference to FIG. 26, the depth of telescopic insertion is limited such that the upper edge 172 of force accumulator tube 154 is generally aligned with the mid-portion of weakening members 174. Weakening members 174 comprise round holes and the lower portion of upright 152 generally resembles connecting tube 70 and weakening member 74, described above. Alternative weakening members such as triangular members 180, four corner-located notch members 184, similar to weakening members 122 and 128 described above may also be employed, as well as other weakening members mentioned herein.

Figure 29:
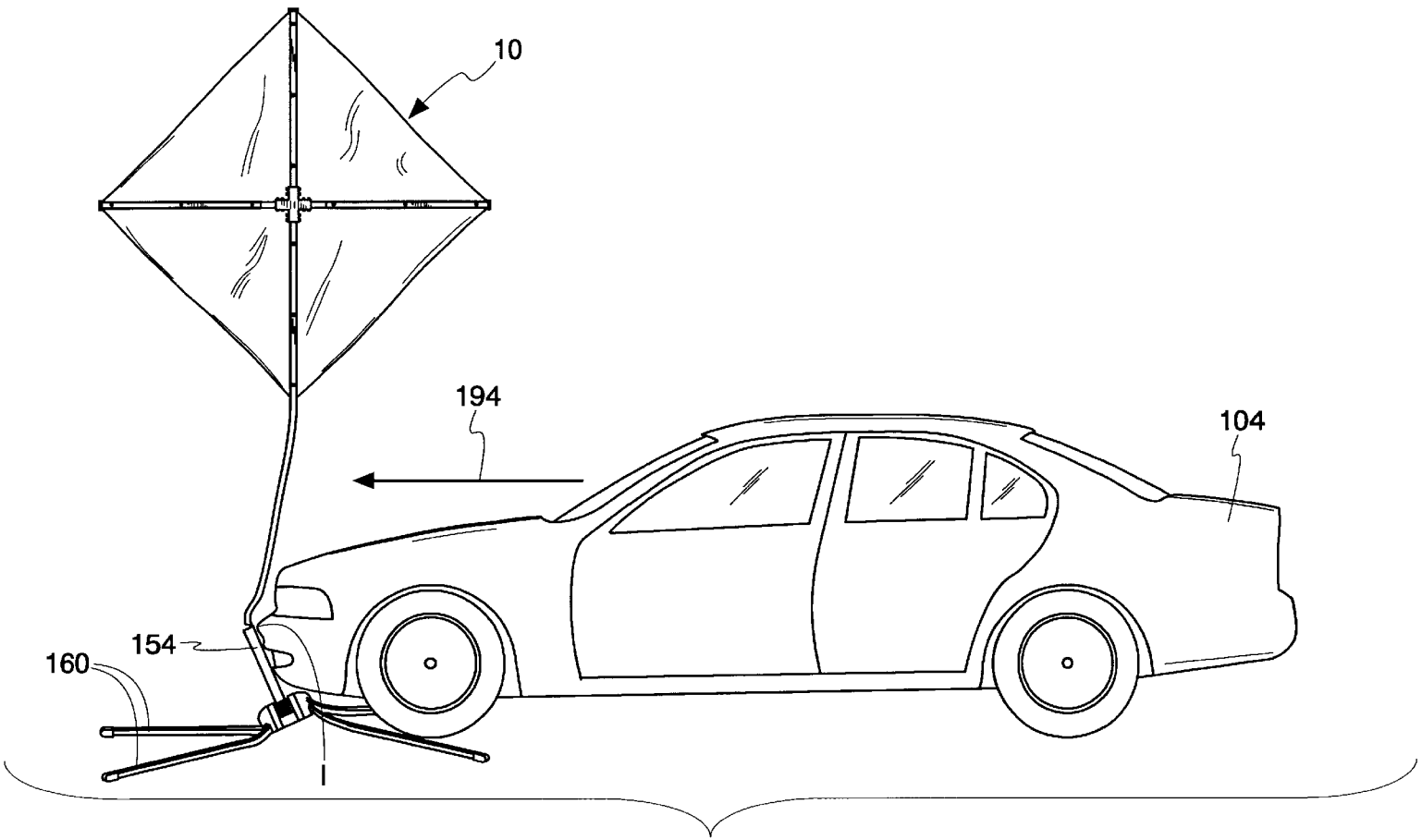
FIGS. 29 and 30 show a sign stand assembly during an impact event.
Figure 30:
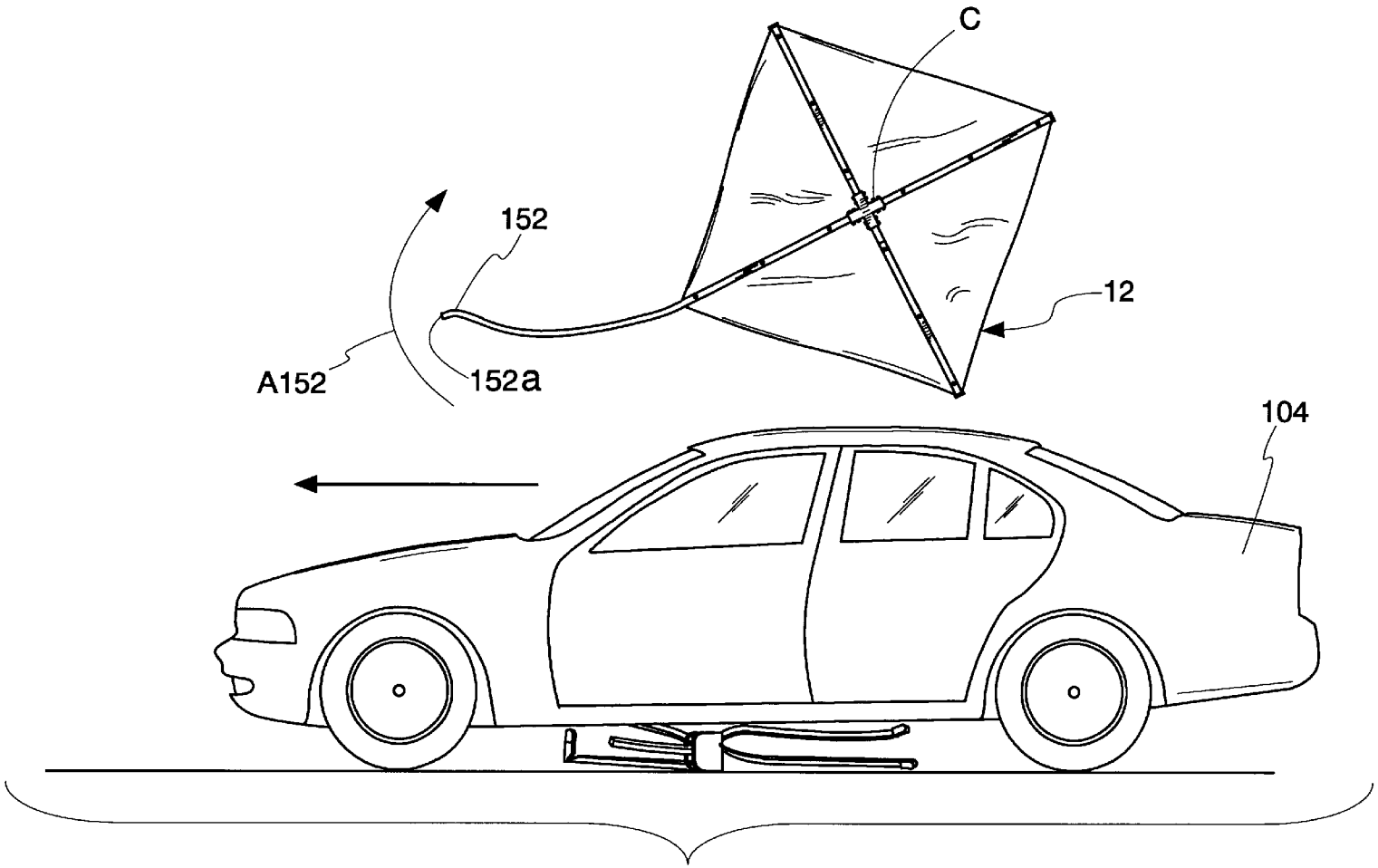

During the impact event shown in FIGS. 29 and 30, a lateral force is applied to the sign assembly by a vehicle 104 traveling in the transverse direction 194. As schematically indicated in FIG. 29, it is generally preferred that force accumulator tube 154 extend to the anticipated height of impact. This efficiently transmits lateral force to the sign assembly to cause a rapid response in the first fraction of a second impact, in which impact forces are efficiently transferred to the horizontal cross-sectional plane of the upright located at or near the horizontal plane containing the weakening members. Most preferably, the rapid response includes rupturing of the lower portion of the upright, separation from the base and rotation in the manner indicated, all within 10 msec and most preferably within 3 msec.

With reference to FIG. 30, it has been observed that the lower free end 152*a* of upright 152 is formed by rupture of the upright along a plane located transverse to the longitudinal axis of the upright. It has further been observed that the planar rupture of the upright lies along or very near a transverse plane containing centers of the weakening members. The upright is almost instantly ruptured and with further application of the impact force, the upper, freed portion of the sign assembly is caused to travel along a path of upward and clockwise (as shown in the figure) movement. The rotational movement moves the sign panel in a direction generally aligned with downstream movement of the vehicle, a motion which raises the ruptured, trailing end in an upward direction. It has been observed that the free end 152*a* is deflected as illustrated in FIG. 30 in a manner which clears the vehicle windshield.

With sign stand arrangements according to principles of the present invention, impact energy severs the upright support of the sign panel 12 with the conversion of remaining impact energy into a rotational motion of the severed sign panel assembly, as indicated by arrow A152 in FIG. 30. It is generally believed that the point of rotation of the severed sign panel assembly is located generally at the center of the sign panel indicated by the reference letter C. The location of the center of rotation of the severed sign panel assembly has merely been observed, and attempts to control or alter the center of rotation have not been found to be necessary at this time. Rotation of the severed sign panel assembly, as graphically indicated in FIG. 30 raises the severed end 152*a* of the sign panel upright support (or "bottom mast") in a manner so as to clear at least the leading end of the impacting object, assumed to be a passenger vehicle.

When principles of the present invention are applied to roadway signs, as depicted herein, it is important that the severed sign panel assembly be moved a sufficient distance with sufficient speed so as to avoid impact with the vehicle windshield. It has been determined that impact energy (as illustrated, for example in FIG. 29) be converted to rotational movement within conversion times of less than 0.1 seconds, preferably a few hundredths of a second after impact. It was discovered during testing that conversion times (the times needed to convert impact energy to rotational movement of a severed sign panel assembly) of a few tenths of a second were too slow to avoid impact with the leading portion of the impacting vehicle. It is also important when designing practical sign stand assemblies according to principles of the present invention, that the point of anticipated impact be determined beforehand. For example, with reference to FIG. 29, the forward most or leading edge of the vehicle bumper will be involved as the initial point of impact of the vehicle with the sign stand assembly. This anticipated point of impact is identified in FIG. 29 by the reference letter I and is measured as distance above the ground supporting legs 60. It has been found important that the point of impact be located approximately at, and most preferably below, the breakpoint of the sign stand assembly in order to avoid pulling or dragging the upper portion of the sign stand assembly under the impacting vehicle, oftentimes with attendant impact between the sign stand assembly and the hood or windshield.

Generally speaking, the present invention is directed to so-called portable sign stand assemblies, that is, sign stand assemblies which are not anchored or fixed to the ground. Accordingly, the present invention contemplates sign stand assemblies which are freely moveable about a working surface such as a roadway or roadway shoulder, for example. As graphically illustrated in FIG. 29, the lowermost portion or mounting base of the sign stand assembly has been observed to undergo distortion with a torsional force. Even with supporting surfaces of reduced friction, such as concrete or asphalt roadway surfaces, the lower portion of the sign stand assembly, that portion containing the ground-engaging legs 60 has been observed to remain relatively stationary so as to undergo little or no travel in the direction of vehicle movement (indicated by arrow 194 in FIG. 29). As illustrated in FIG. 30, the severed supporting base of the sign stand assembly is generally crumpled underneath the passing vehicle. The controlled break point of the sign stand assembly determined according to principles of the present invention defines the portion of the sign stand assembly which is passed over by the impacting vehicle. Generally speaking, movement of the severed sign panel assembly portions resulting from vehicle impact is transferred almost entirely to the upper, severed portion of the sign panel assembly. Accordingly, with the principles according to the present invention, impact energy is resolved into rotational or other displacement of the upper sign panel portion and crumpling or other deformation of the lower sign panel assembly portion. Even if the lower sign panel assembly portion is made to undergo substantial travel in the direction of vehicle movement, it is expected that at least some of the outwardly projecting support legs will be trapped under the forward portion of the vehicle so as to prevent the lower sign stand assembly portion bouncing or otherwise being displaced to the height of the vehicle hood and windshield.

Figure 28:
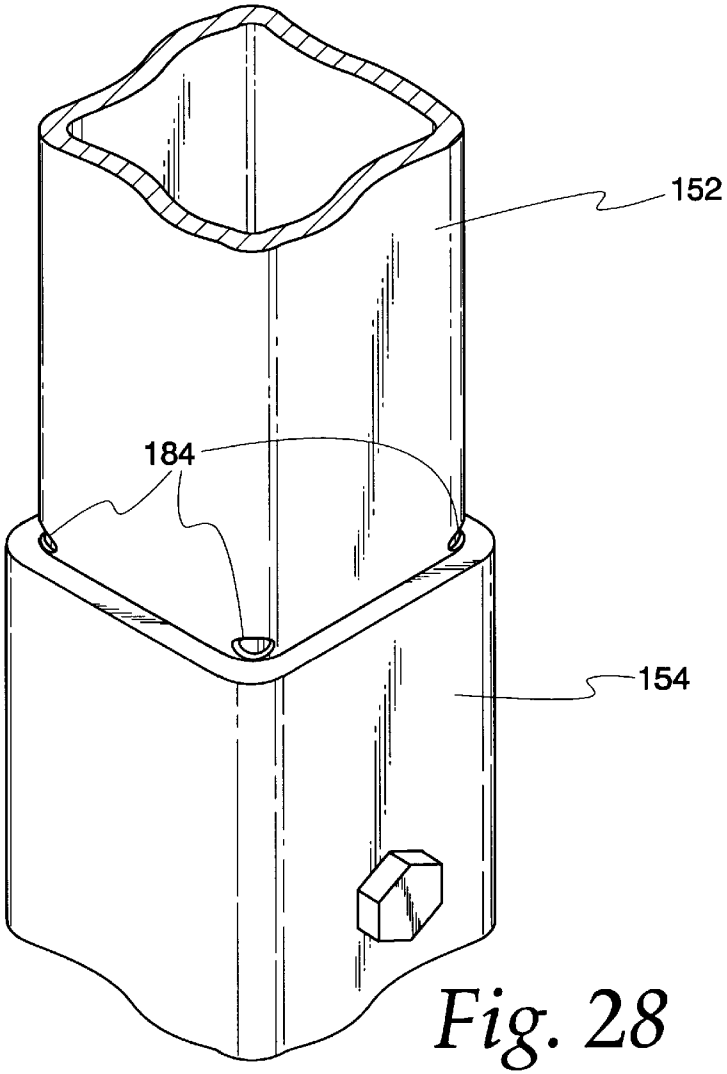

In the various examples shown above, and in the examples to follow weakening members such as holes, notches or score lines are most preferably aligned with the upper or working end of the force accumulator member. For example, with reference to FIG. 26, weakening members in the form of holes 174 are located in the immediate vicinity of the upper edge 172 of force accumulator member 154. Most preferably, as explained above, as preferred that edge 172 be aligned so as to cover a portion and most preferably a mid-portion of the holes 174. Depending upon the absolute dimensions of the support member 152 and force accumulator member 154 and the dimensions of weakening holes 174, holes 174 can be displaced vertically relative to working edge 172. In particular, the holes 174 can be displaced up to twice the diameter of the holes, either above or below working edge 172. For example, when the holes 174 are displaced up to two hole diameters above working edge 172, rupture of the support member 152 is reliably obtained, and localized at or near a horizontal plane intersecting the holes 174. Alternatively, if the holes 174 are displaced below edge 172 at a distance up to two hole diameters, rupture of the supporting member 152 will occur within force accumulator member 154, below the edge 172. Impact energy will reliably result in result in rupture of the support member at a point adjacent the holes 174 and will readily pull support member 152 from the force accumulator member with a speed sufficient to insure rotation in the manner indicated above with reference to FIG. 30. For weakening members of other shapes such as triangular openings in FIG. 27 and corner notches in FIG. 28 hole sizes can be determined which will encompass the weakening members. When score lines are employed as a weakening member, the amount of displacement above and below the working edge of the force accumulating member is measured in terms of thicknesses of the support member walls, rather than hole diameters. Accordingly, when a weakening score line is employed the score line can be displaced above and below the working edge of the force accumulating member by a distance up to twice the thickness of the support member walls. It should be born in mind that not only must breaking of the sign panel assembly be controlled so as to be limited to a defined area, but also the breaking must be completed such that rotation of the upper sign panel portion be at least initiated within the first few hundredths of a second after impact in order to insure impact with the defined crash test vehicles be avoided.

Figure 31A:
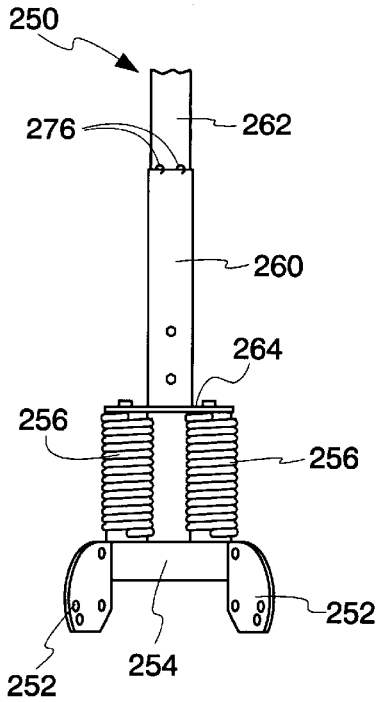
FIG. 31*a* is a fragmentary elevational view of another sign stand support.

Turning now to FIGS. 31*a,* 31*b* a sign stand assembly is generally indicated at 250. A portable sign stand support base for the assembly includes a leg support portion having body plates or flanges 252 which receive ground engaging legs in a conventional manner. The leg support portion of the support base further includes a platform portion 254 to which the flanges are attached in a conventional manner, preferably by welding. The support base further includes a pair of vertically oriented coil springs 256 are mounted at their lower ends of platform 254 to provide support for the remainder of the overlying sign stand assembly.

A force accumulating tube 260 is hollow and dimensioned so as to receive the lower end of an upright (or "bottom mast") member 262, a bracket member or attachment plate 264 is secured to the lower end of force accumulator tube 260 in a conventional manner, preferably by welding. The force accumulator tube 260 is coupled to the springs 256 through the bracket member or attachment plate 264 secured to the force accumulator tube and through threaded fastener members 257. Included are coil connector members 258 engaged with the springs 256. The coil connectors 258 receive the threaded fastener members 257, thus securing the springs 256 to the bracket or attachment plate 264. Coil connectors at the lower ends of springs 256 receive a separate pair of threaded fasteners 257, effectively securing the lower ends of the springs 256 to platform portion 254. The upright member 262 is telescopically inserted in force accumulator member 260 until holes 266 are aligned with holes 268, allowing passage of bolt fasteners 270 there through. With tightening of nut fasteners 272, upright member 262 is fixedly secured within force accumulator member 260. Relative positioning of the holes 266, 268 bring weakening members 276 into desired alignment with working edge 278 of force accumulating member 260. For example, when weakening members 276 are provided in the form of round holes, the most preferred alignment is that identified in FIG. 26. As indicated above, weakening members 276 can be displaced above and below working edge 278, within defined limits. In practical operation wind loadings applied to sign panels carried by upright 262 are resolved by springs 256 in a conventional manner. However, the springs do not interfere with the rupture of upright member 262 with the required speed indicated above, when the sign stand assembly is impacted at a point below the weakening members 276. Although it is generally preferred that the impact be determined at a point below weakening members 276, it is anticipated that successful, timely rupturing and clearing of the leading end of the vehicle will still be accomplished if the point of impact is localized above but very close to the severing members 276. For example, contact directly on the upright 262 may in certain instances result in the desired vehicle-clearing motion of the sign stand assembly. It is preferred that the impact be directed to the force accumulator member so as to render the desired clearing movement reliable over a wide variety of equipment and environmental conditions.

Figure 32A:
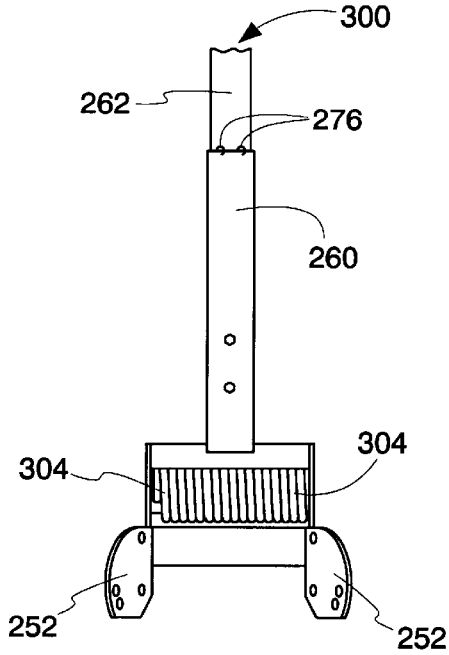
FIG. 32*a* is a fragmentary elevational view of another sign stand support.
Figure 32B:
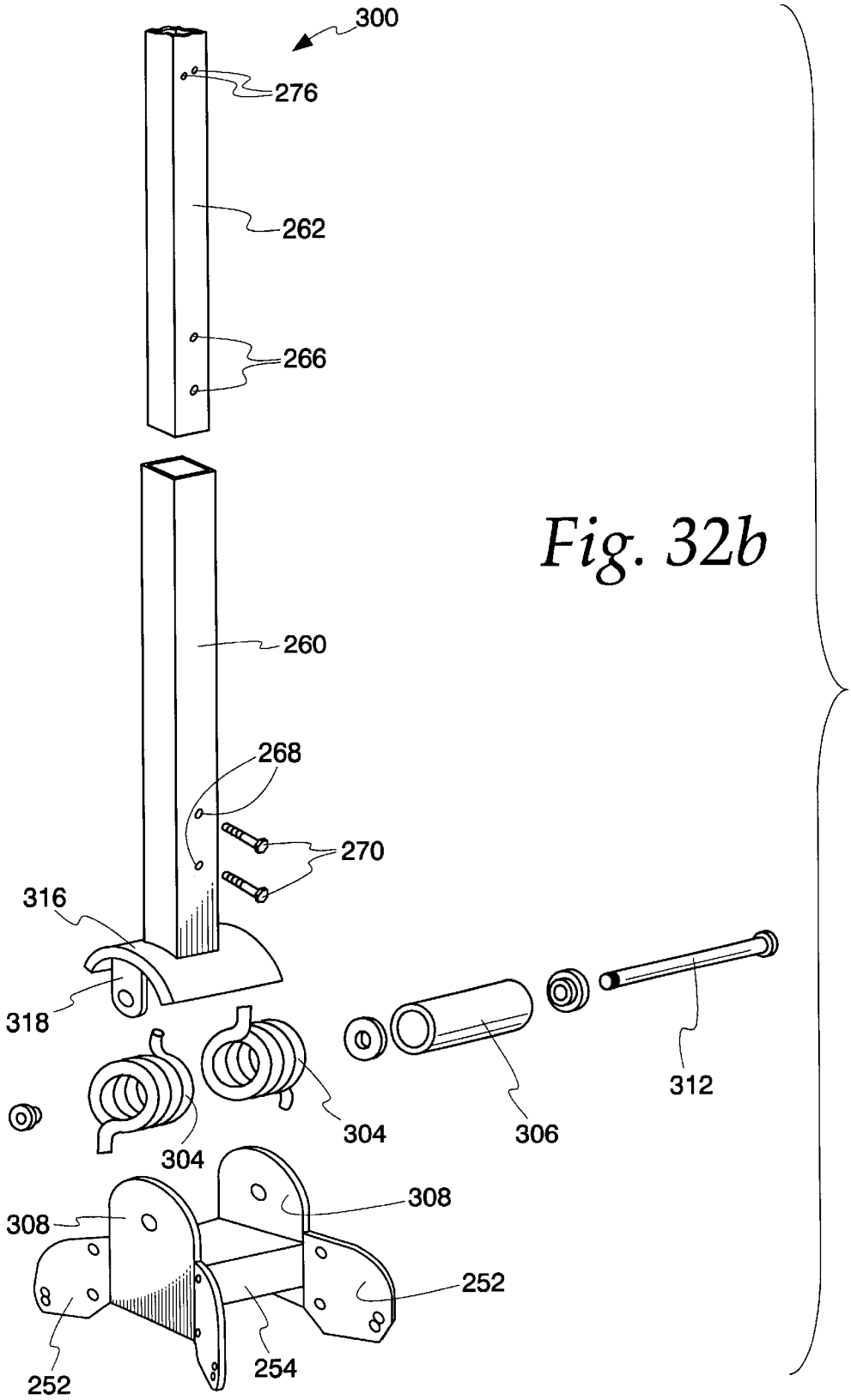
FIG. 32*b* is an exploded perspective view thereof.
Figure 32C:
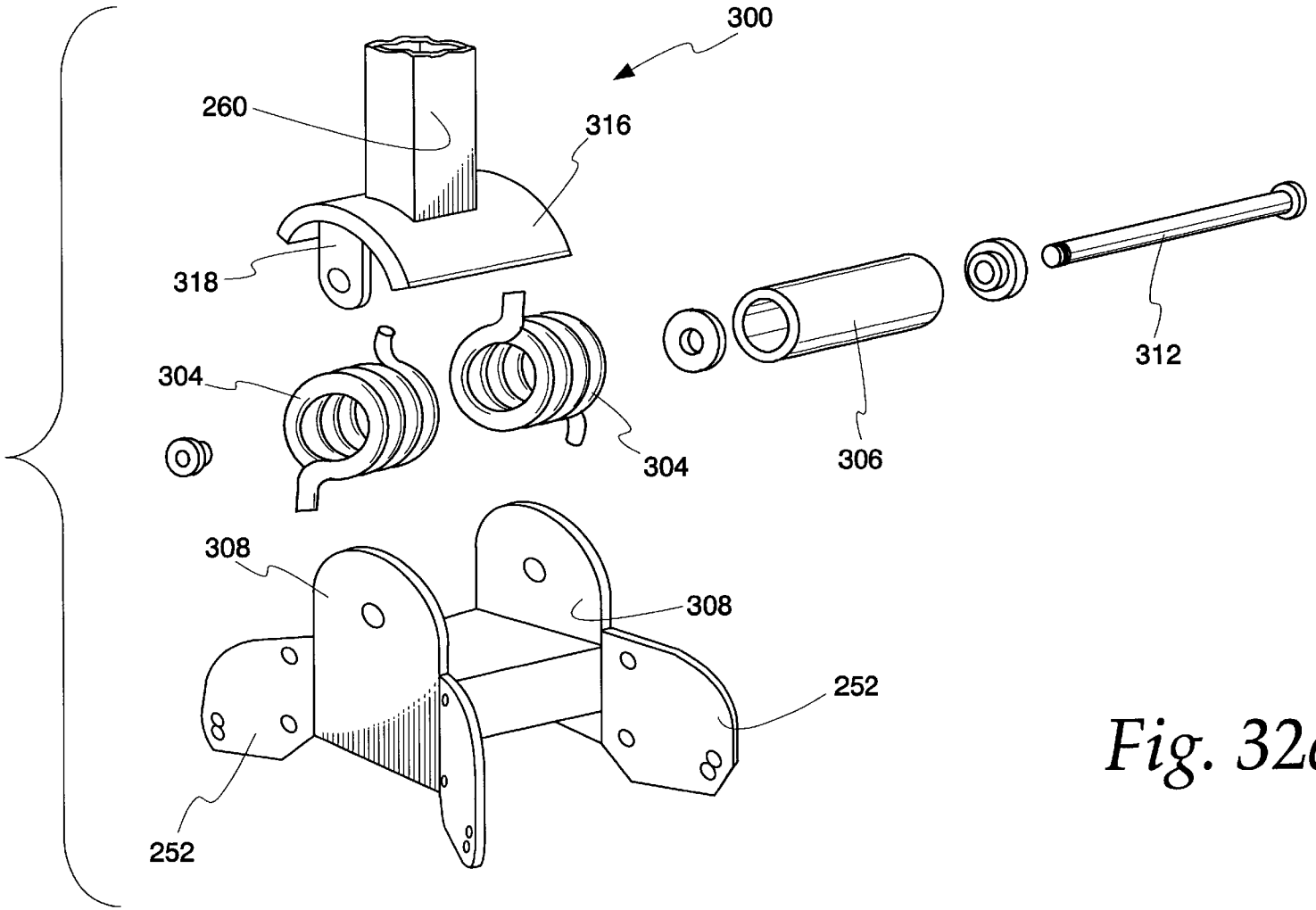
FIG. 32*c* is a fragmentary exploded view thereof shown in perspective.

Turning now to FIGS. 32*a*–32*c*, a sign stand assembly generally indicated at 300 has an upright member 262 and a force accumulating member 260 generally similar to that described above with reference to FIG. 31*a*. In a similar manner, sign assembly 300 is also spring mounted to deflect wind loads carried by upright member 262. With reference to FIG. 32*c*, the sign stand assembly 300 uses a pair of horizontally aligned torsionally loaded coil springs 304 supported on an internal spring support 306 and secured between upper ends 308 of flanges 252 by a bolt fastener 312. The lower end of force accumulator member 260 is secured to a curved wall or fender 316 by conventional means, such as welding. Legs 318 include apertures for receiving bolt 312.

Figure 33A:
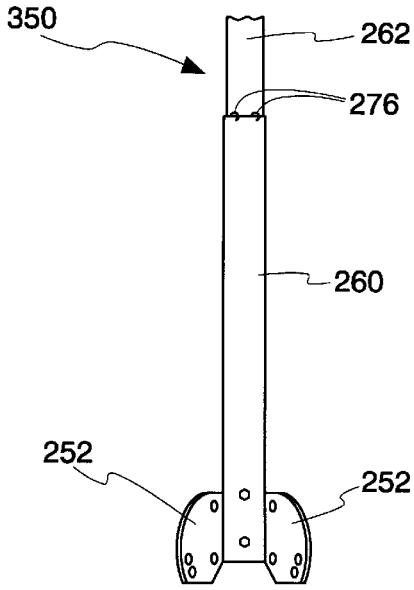
FIG. 33*a* is a fragmentary elevational view of another sign stand support.
Figure 33B:
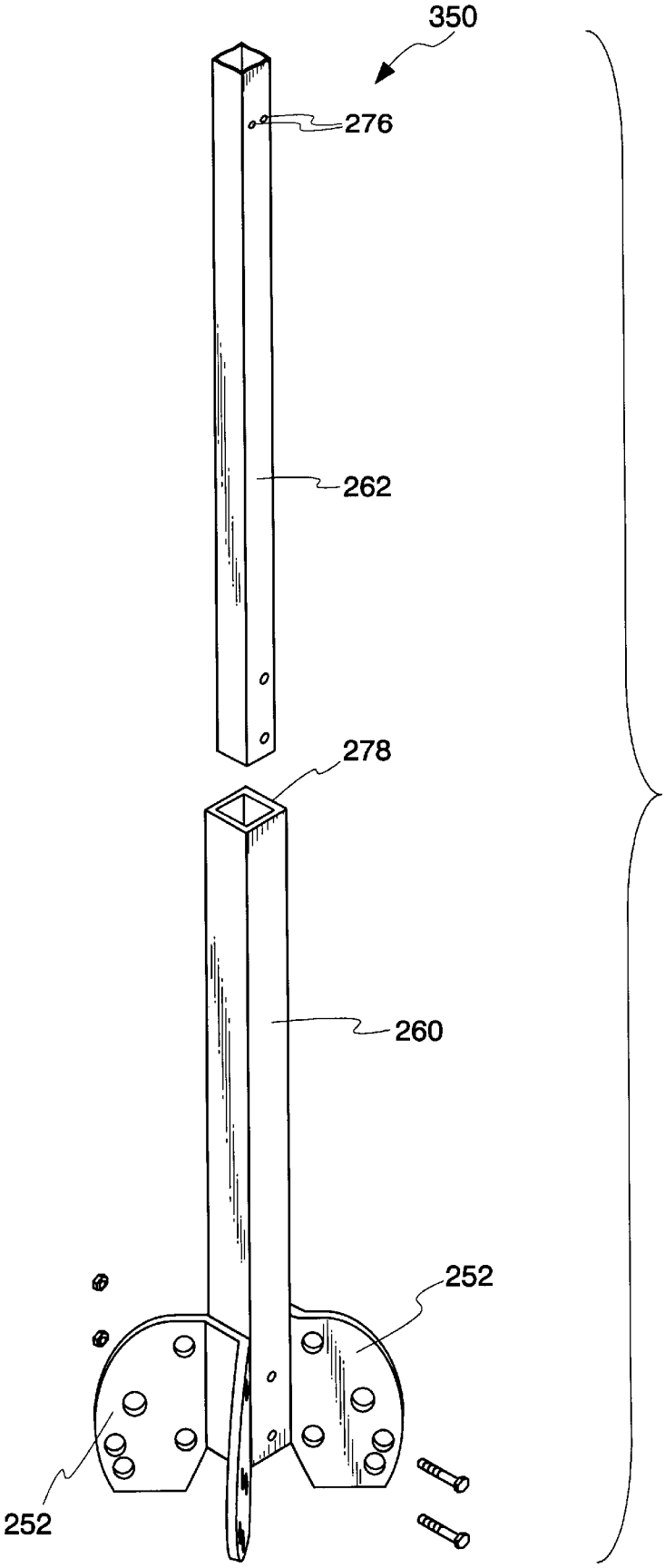
FIG. 33*b* is an exploded perspective view thereof.

Referring now to FIGS. 33*a*, 33*b* sign stand assembly 350 includes an upright member 262 and a force accumulator member 260, as described above. The lower end of force accumulator member 260 is fixedly secured to flanges 252 by conventional means, such as welding. In a manner described above, the working end 278 of force accumulator member 260 is aligned with weakening members 276. In the arrangement illustrated in FIGS. 33*a*, 33*b* a rigid non-springing support is provided for the sign panel carried by upright 262.

Figure 34A:
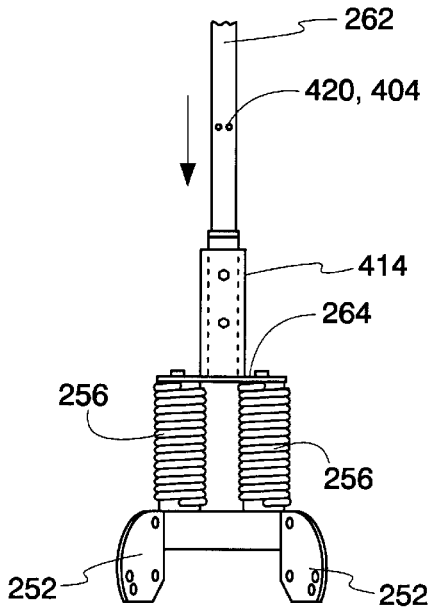
FIG. 34*a* is a fragmentary elevational view of another sign stand support.
Figure 31B:
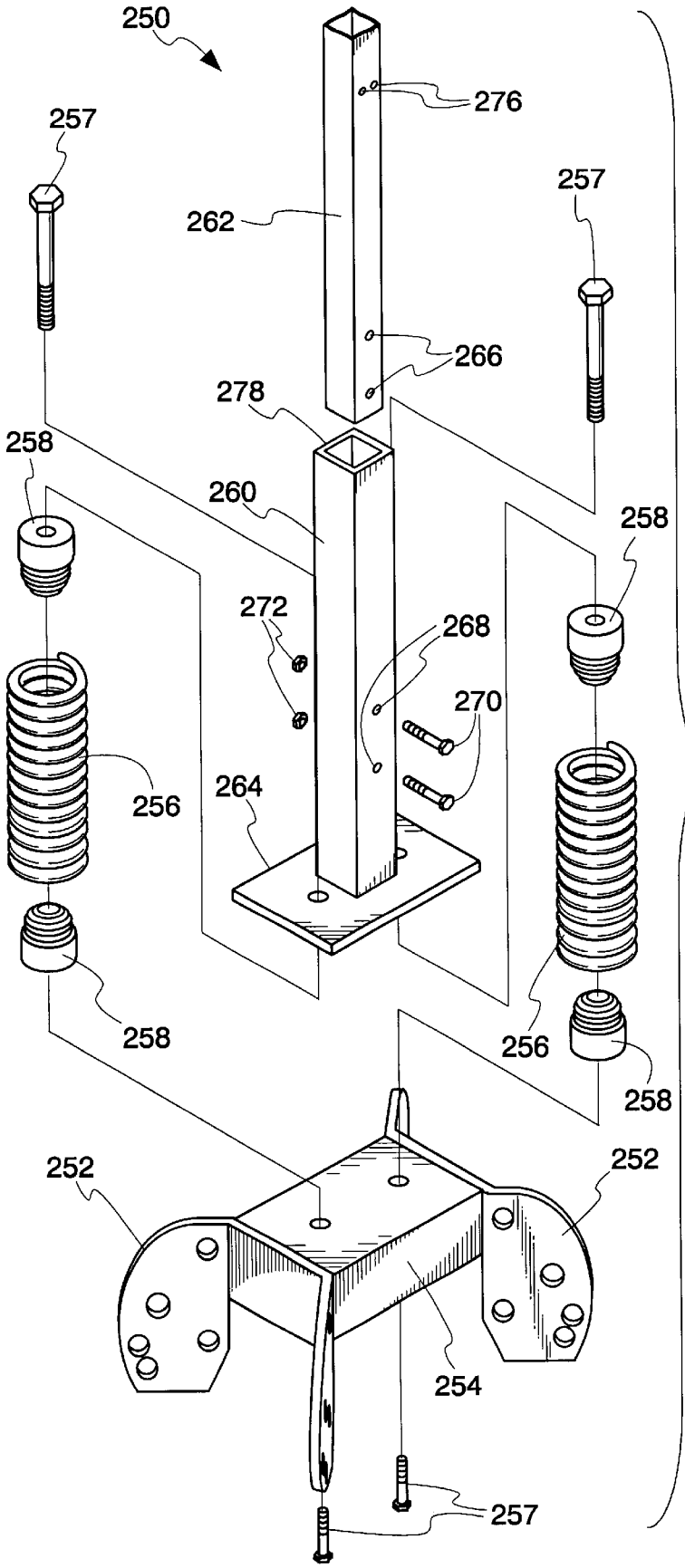
FIG. 31*b* is an exploded perspective view thereof.
Figure 34B:
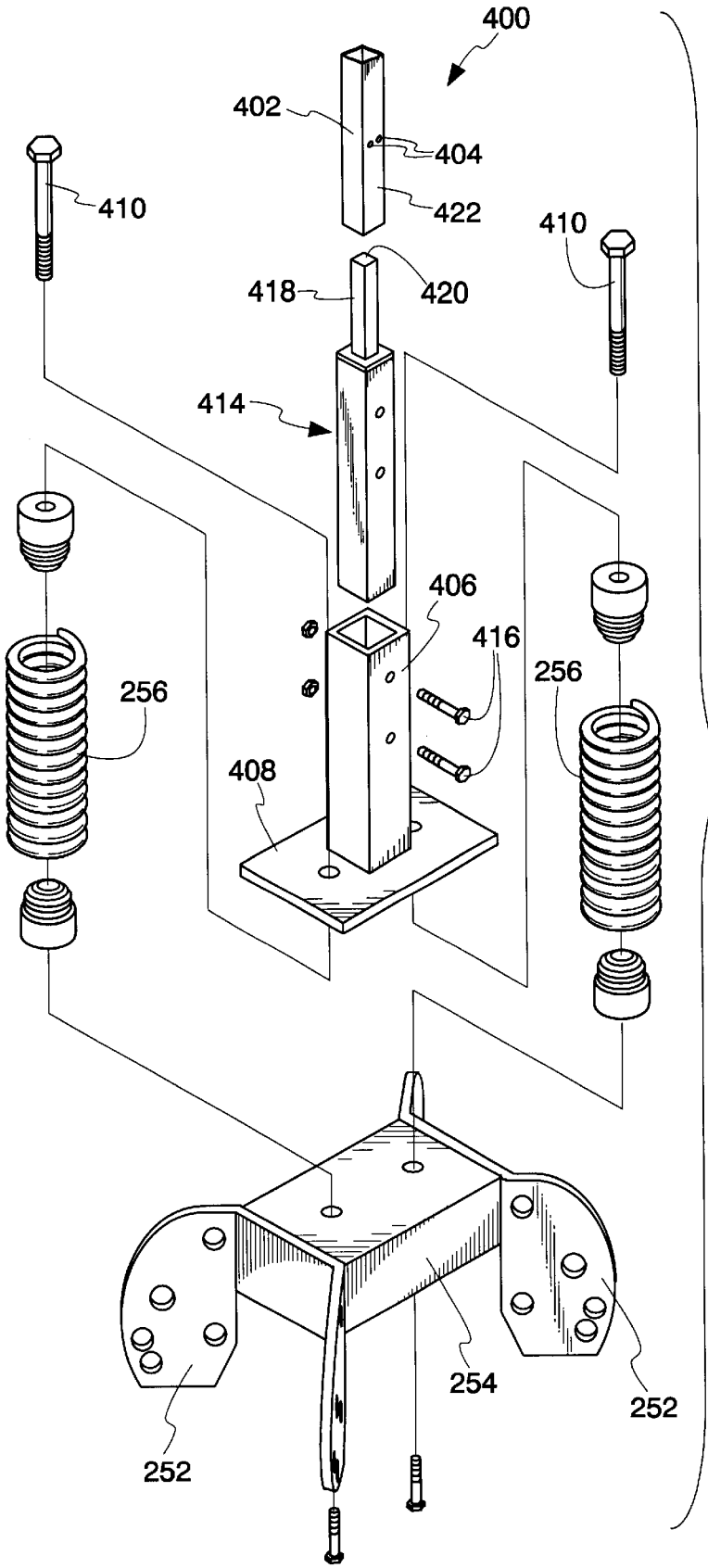
FIG. 34*b* is an exploded perspective view thereof.

Turning now to FIGS. 34*a*, 34*b* a sign stand assembly 400 includes an upright member 402 having weakening members 404. A mounting tube 406 is secured to a mounting plate 408 by conventional means, such as welding. Mounting plate 408 is in turn coupled through coil springs 256 to platform 254 of the leg support in the manner indicated above with reference to FIG. 31*b*. Support tube 406 is hollow, dimensioned to receive the lower end of a stepped coupler 414, and is secured thereto with bolt fasteners 416. The upper end 418 of stepped coupler 414, is dimensioned to be received within the hollow interior of upright 402. The upper end of stepped coupler 414, comprises a force accumulator member, with the free end 420 aligned with weakening members 404. If desired, the lower end 422 of upright 402 may be secured to internal support 418 using conventional techniques such as bolt fasteners or welding. Such joinder, as mentioned is limited to the lower portion of upright 402, below weakening members 404. In the sign stand assembly 400, the force accumulator member operates internal to the upright member carrying the sign panel. If desired, the upper portion 418 can be mounted directly to mounting tube 406 by welding or other conventional fastening techniques.

Figure 35A:
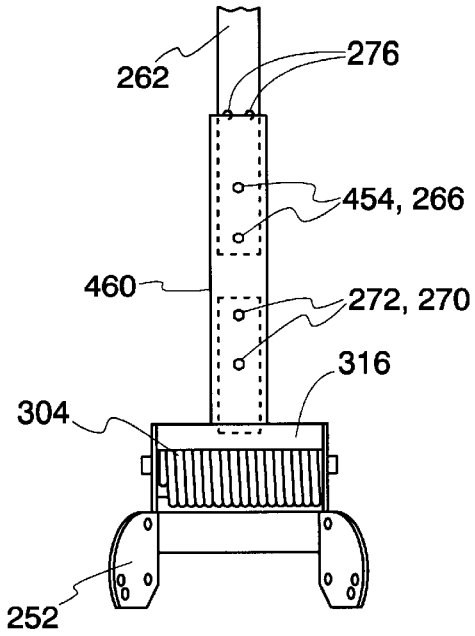
FIG. 35*a* is a fragmentary elevational view of another sign stand support.
Figure 35B:
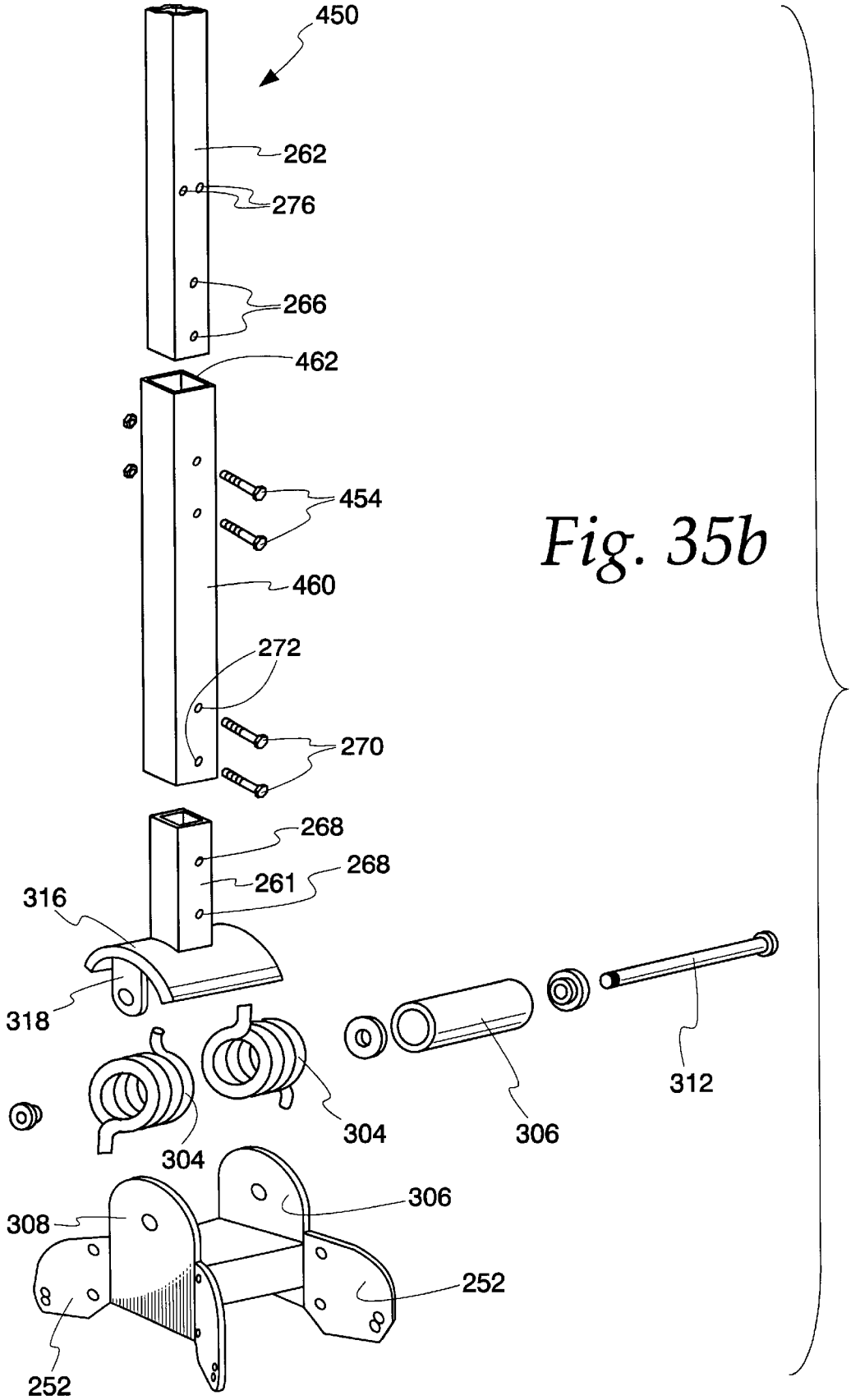
FIG. 35*b* is an exploded perspective view thereof.

Turning now to FIGS. 35*a* and 35*b*, a sign stand assembly 450 bears resemblance to the sign stand assembly 300. For example, mounting tube 261 is mounted through curved wall 316 and ears 318 to a bolt fastener 312 which passes through upper ends 308 of flanges 252. Torsion springs 304 provide an upright resilient bias to mounting tube 261. Upright tube 262 includes weakening members 276 and mounting apertures 266 which receive bolt fasteners 454. A force accumulating coupling member 460 couples the mounting tube 261 and the lower end of upright 262. Coupling member 460 preferably comprises a hollow tube dimensioned to telescopically receive both mounting tube 261 and upright 262. The coupling member 460 functions as a force accumulating member, and has an upper working end 462 which is aligned adjacent weakening members 276. The desired alignment is retained by bolt fasteners 454 which pass through coupling member 460 in the lower end of upright 262 telescopically inserted within the coupler 460. Bolt fasteners 454 pass through apertures 266 in the lower end of upright 262. Bolt fasteners 270 pass through apertures 268 being received in apertures 272 formed in the lower end of coupler 460.

Figure 36A:
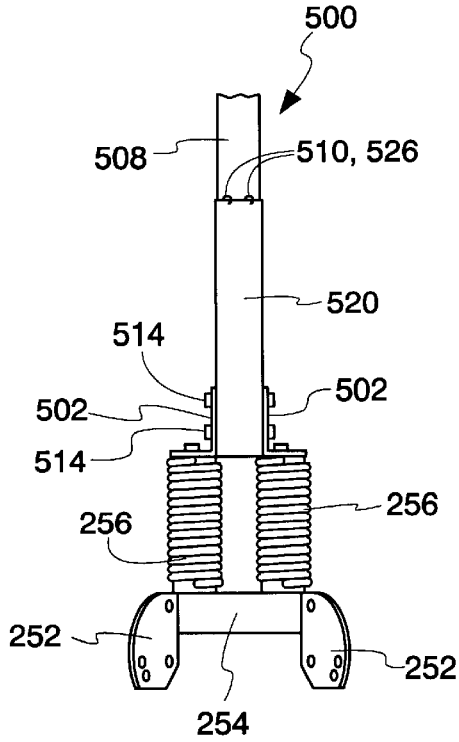
FIG. 36*a* is a fragmentary elevational view of another sign stand support.

Turning now to FIG. 36*a*, sign stand assembly 500 includes mounting springs 256 and flanges 252, as described above with reference to FIG. 31*a*. Mounting brackets 502 are secured to the lower end 506 of an upright 508, containing weakening members 510. Bolt fasteners 514 pass through apertures in the base plate 502 and through apertures 516 in upright 508 in the manner indicated in FIG. 36*a*. A force accumulating coupling member 520 receives the lower end 506 of upright 508 and includes holes 522 aligned with holes 516 so as to receive bolt fasteners 514. The accumulator member 520 includes an upper working end 526 aligned adjacent the weakening members 510 of upright 508.

Figure 37A:
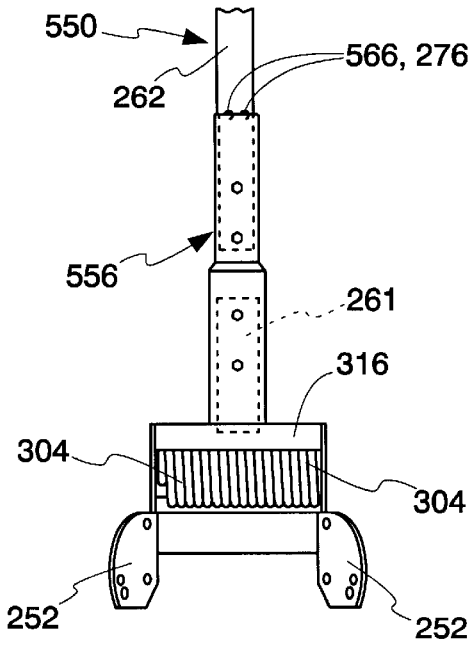
FIG. 37*a* is a fragmentary elevational view of another sign stand support.
Figure 37B:
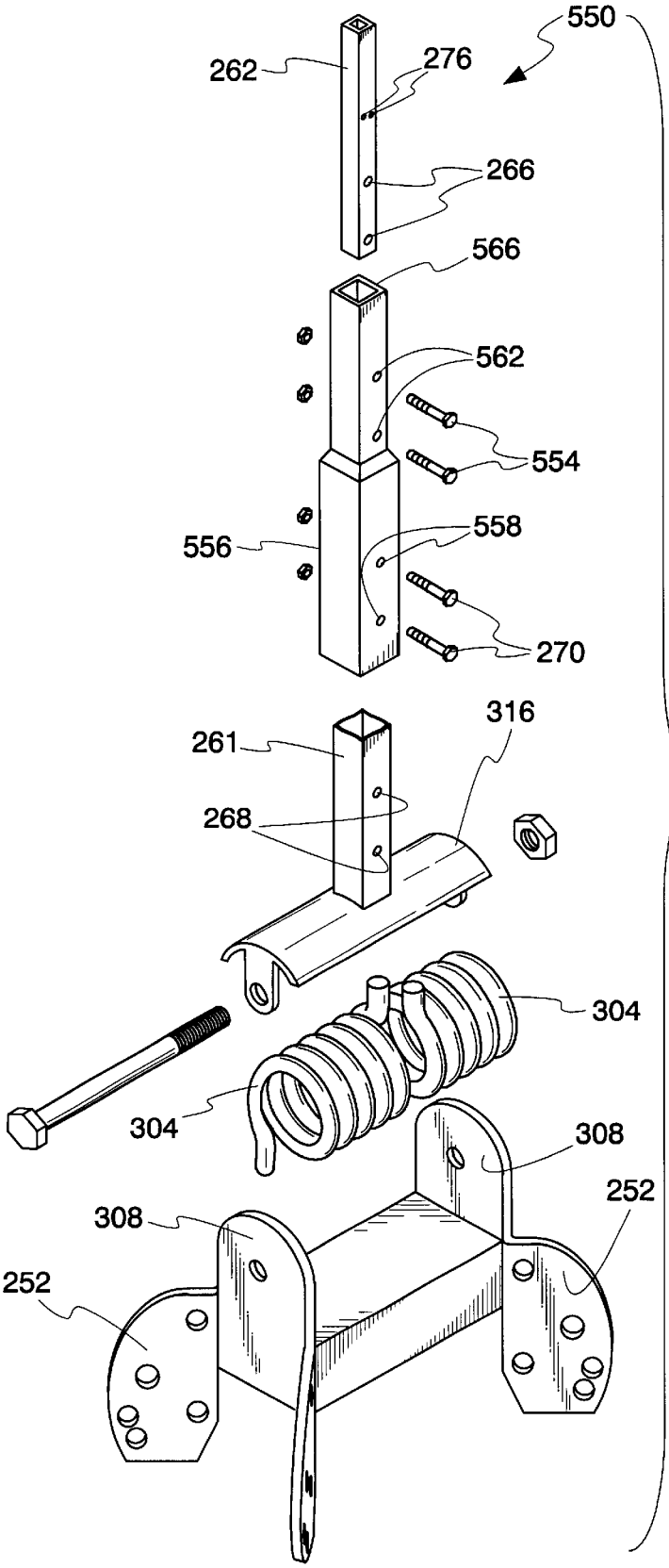
FIG. 37*b* is an exploded perspective view thereof.

Turning now to FIGS. 37*a*, 37*b*, a sign support assembly 550 has a base mounting which includes torsional springs 304 which resiliently bias a mounting tube 261 carried by curved wall 316. An upright 262 includes weakening members 276 and mounting holes 266 to receive threaded fasteners 554. A stepped coupler or force accumulating coupler member 556 is hollow and dimensioned to telescopically receive mounting tube 261. Bolt fasteners 270 pass through mounting holes 558 in the stepped coupler and holes 268 and mounting tube 261.

The upper portion of stepped coupler 556 is dimensioned to telescopically receive the lower end of upright 262. Bolt fasteners 554 pass through mounting holes 562 in the coupler and 266 in the upright 262. The upper end of coupler 556 serves as a force accumulating member and has a working upper end 566, which is aligned with weakening members 276.

Figure 38A:
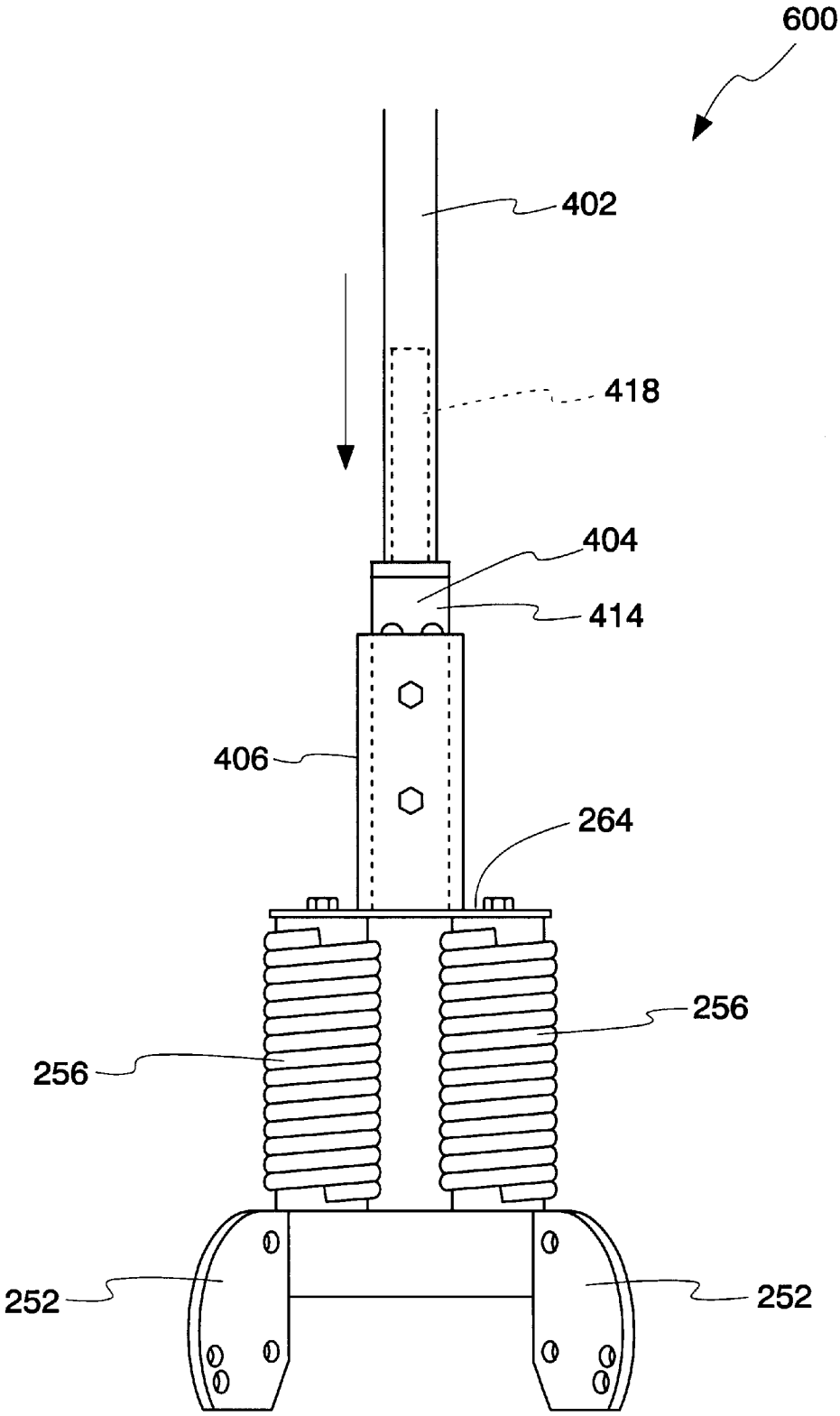
FIG. 38*a* is a fragmentary elevational view of another sign stand support.
Figure 38B:
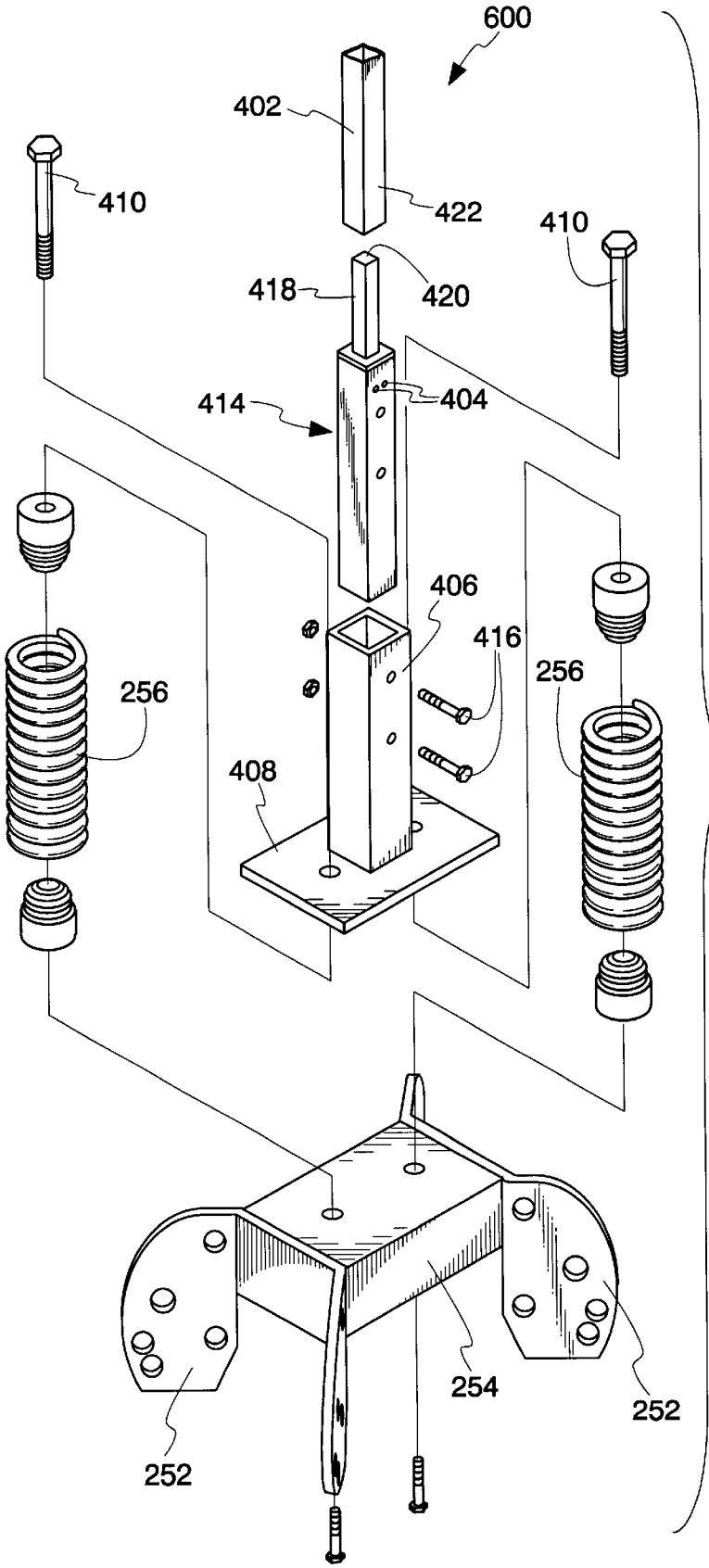
FIG. 38*b* is an exploded perspective view thereof.
Figure 39:
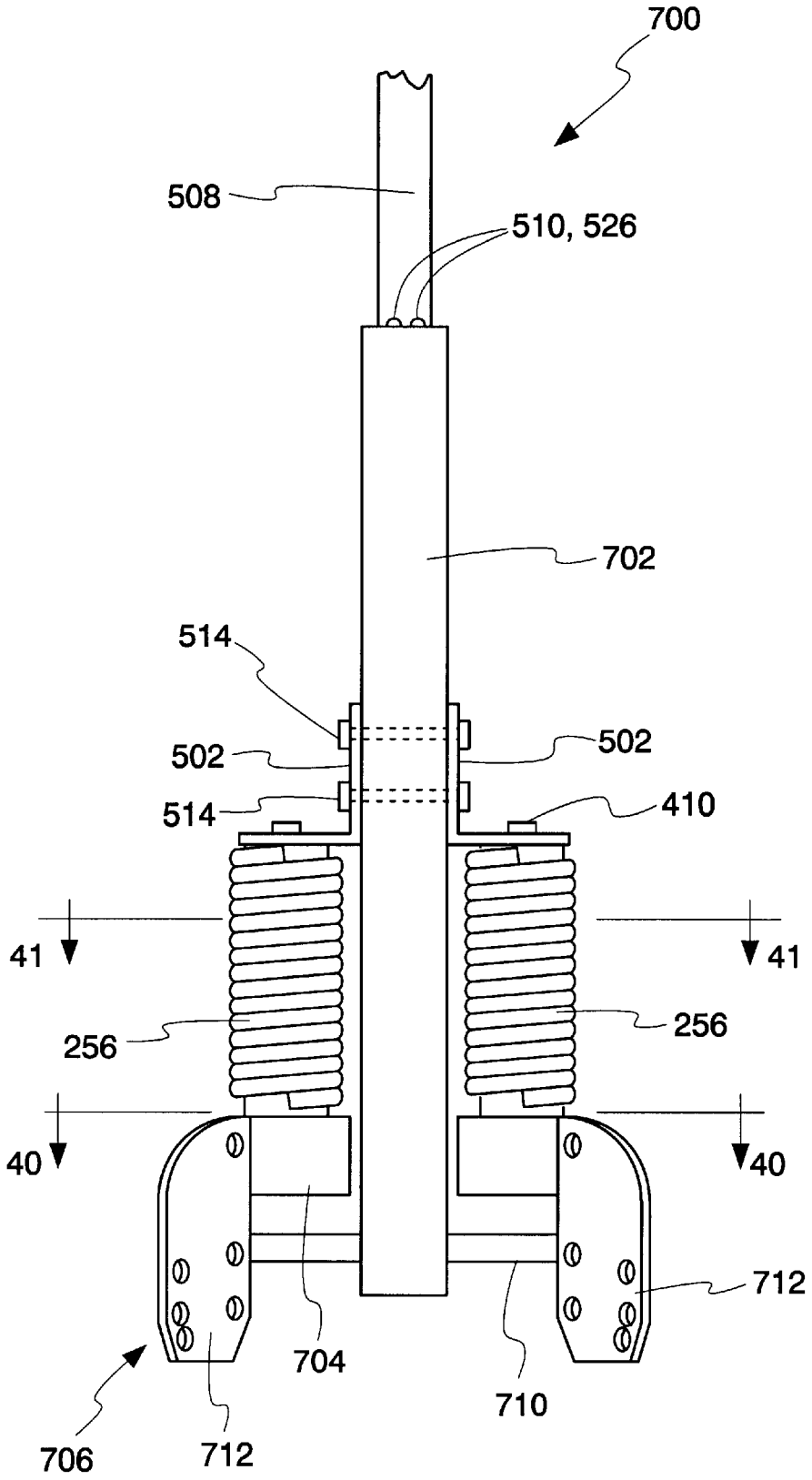
FIG. 39 is a fragmentary elevational view of another sign stand support.

Referring now to FIGS. 38*a*, 38*b* a sign support assembly 600 has features similar to the sign supporting assembly 400 described above with reference to FIGS. 34*a*, 34*b*. Sign support assembly 600 differs from the sign support assembly 400 in that weakening members 404 are located on stepped coupler 414 and the lower end 422 of upright 402 is unweakened, and is firmly secured to the upper end 418 of stepped coupler 414, using conventional fastening means, such as threaded fasteners, pins, or metallurgical joinder. The stepped coupler 414 is inserted through the upper open end of mounting tube 406 and remaining aspects of the construction are as described above with reference to FIGS. 34*a*, 34*b*. If desired, the weakening members can be transferred to other couplers as shown herein. For example, with reference to FIGS. 37*a*, 37*b* the weakening members can be transferred to the mid-portion of coupler 556, at a point adjacent the upper free end of mounting tube 261, which would then function as the force accumulator member. With reference to FIGS. 35*a*, 35*b*, the weakening members could be transferred to the mid-portion of coupler 460, adjacent the upper free end of mounting tube 261, which would function as a force accumulator member.

Figure 36B:
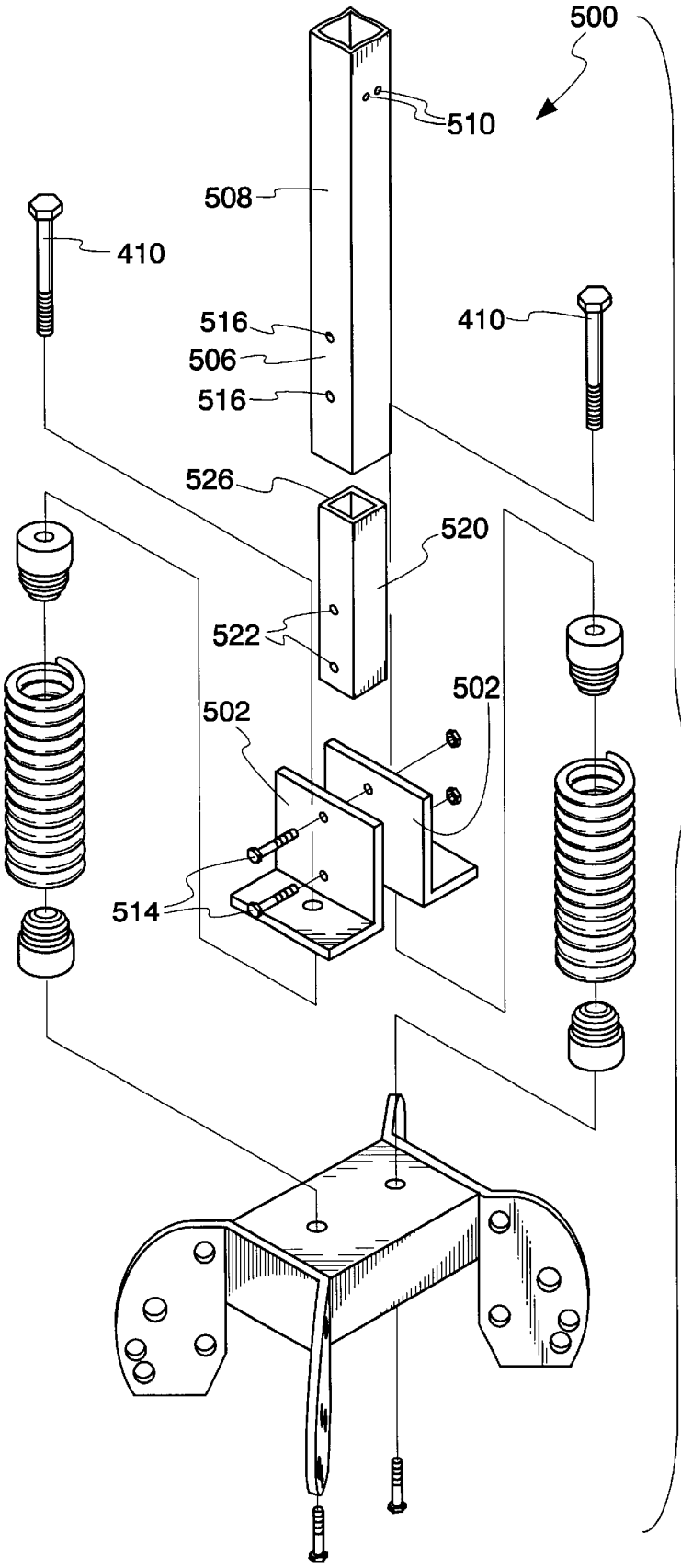
FIG. 36*b* is an exploded perspective view thereof.
Figure 40:
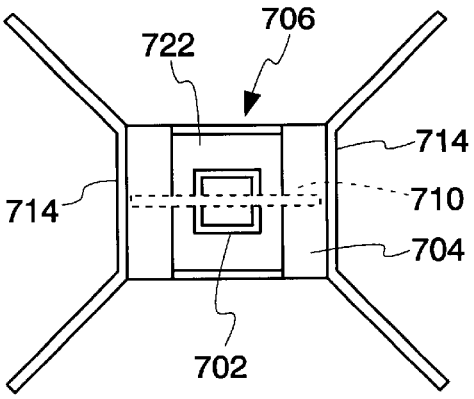
FIG. 40 is a cross-sectional view taken along the line 40—40 of FIG. 39.
Figure 41:
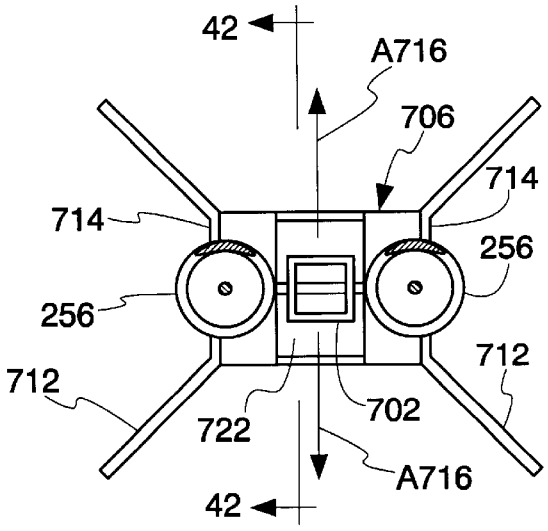
FIG. 41 is a cross-sectional view taken along the line 41—41 of FIG. 39.
Figure 42:
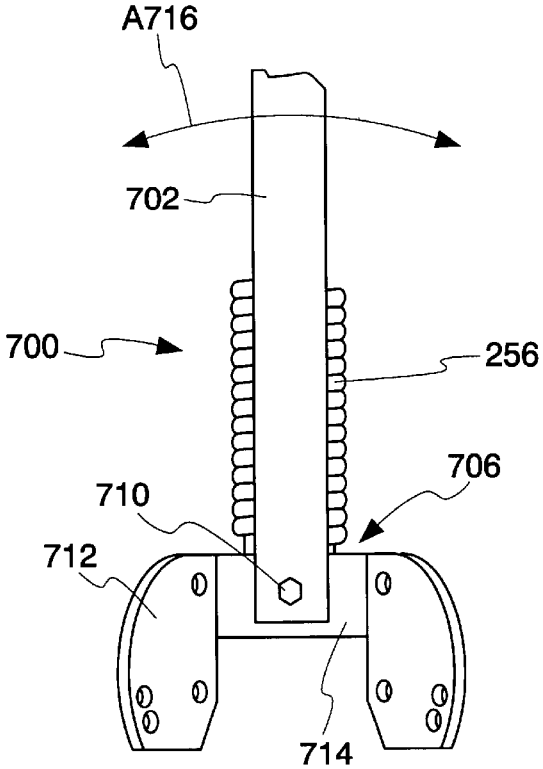
FIG. 42 is a cross-sectional view taken along the line 42—42 of FIG. 41.

Referring now to FIGS. 39–42, a sign support assembly 700 has certain features similar to those of system 500 described above with reference to FIGS. 36*a*, 36*b*. As will be seen herein, force accumulator tube 702 has a lower end portion which passes through platform portion 704 of portable base 706. The lower end of force accumulator tubes 702 is pivotally connected to the portable base by an axle member 710 which is joined at its ends to flanges 712. Flanges 712 provide pivotal support for collapsible ground-engaging legs, such as the legs 60 shown in FIG. 1. As can be seen in FIGS. 41 and 42, flanges 712 include generally flat central portions 714 at which the ends of axle 710 are mounted. As indicated in FIG. 42, force accumulating member 702 is free to rotate about the axis of axle 710, in the direction of arrow A716. Movement of force accumulator member 702 is constrained by coil springs 256 which are mounted at their lower ends to platform 704 (see FIG. 39) using conventional attachment means, preferably in the form of conical threaded members such as those illustrated in FIG. 36*b* for threaded engagement with the internal bore of springs 256. The upper ends of springs 256 are coupled through threaded connectors to L-plates 502. Plates 502 are in turn joined to the force accumulator member 702 by cross bolts 514. Upright 508 is telescopically joined with force accumulator tube 702 in the manner indicated in FIG. 39, and carries a design panel. Wind loadings captured by the sign panel applied loadings to the force accumulator member, causing the force accumulator member to undergo pivotal rotation as indicated in FIG. 42. Movement of the force accumulator tube associated with wind and other loadings is damped by coil springs 256, the bottoms of which are fixed while the tops of which undergo foreshortened pivotal movement. As indicated in FIGS. 40 and 41, platform 704 defines an internal opening or channel 722, which allows force accumulator tubes 702 to move freely in the direction of arrow A716 in FIGS. 41 and 42. Weakening members 510 cooperate with the upper end of force accumulator tube 702 to provide the desired response to impact forces, as described above.

If desired, the improved, portable base with pivotal mounting can be employed without use of weakening members. For example, the upright tube 508 can be provided in a conventional unweakened fashion with tube 702 providing a convenient telescopic mounting for tube 508. As a further alternative, tube 702 can be made to extend to the top of the sign panel and beyond, if necessary. This latter arrangement is less preferred since it does not accommodate a take-down system where the sign panel and/or upright mast are readily separated from the supporting base.

Other options are also possible. For example, tube 702 can be mounted entirely above the portable base. For example, upstanding ears can be provided on platform 704, preferably inboard of springs 256. The axle member 710 will then be located to extend between the upstanding ears to provide pivotal mounting for the bottom of tube 702. In this manner, the bottom free ends of tube 702 will be constrained to a swinging motion above the portable base. If desired, the force accumulator tube 702 can accommodate a stepped coupler, such as the coupler 404 shown in FIG. 38*a* or a stepped coupler of the type shown in 37*b*, identified by 556. Although hollow square cross-section tubes have been illustrated in FIGS. 39–42, the sign stand arrangements illustrated in these figures, as well as the preceding figures, can have cross-sections of other polygonal shapes having three sides or five sides or more. Furthermore, inner telescopic members can have solid cross sections. For example, the upper portions of stepped couplers can be made to have a solid cross section or alternatively the entire stepped coupler can be made solid, since the stepped couplers described above do not contain weakening members for controlled breaking under impact. Of course, the present invention contemplates sign stand arrangements where a stepped coupler or unstepped coupler does contain weakening members so as to break during impact. In these latter arrangements, sign stand components coupled to the coupler in a telescopic interfitting fashion function as a force accumulator tube. One example of this type has been described above with reference to FIGS. 38*a*, 38*b*.

As can be seen from above, the present invention provides an arrangement for converted impact energy to vehicle-clearing rotational movement in a time critical, rapid fashion. With arrangements according to principles of the present invention, upper portions of sign stand assemblies, can be reliably ruptured and rotated so as to avoid conflict with the leading end of an impacting object, such as a passenger vehicle. Various commercially practical embodiments of sign stand assemblies incorporating principles of the present invention have been provided. It should be understood that any of the forms of weakening members described herein can be interchangeably used or combined with any of the described sign stand assemblies. Further, commercially practical embodiments of sign stand assemblies can be constructed to incorporate principles of the present invention, using a wide variety of metal alloys and fastening systems. Further, materials other than metals and metal alloys can be employed. Various arrangements of weakening members and force accumulating members have been described with respect to implementations using metals and metal alloys. If desired, metallic components can be replaced by non-metallic materials, although this has not been found to be necessary. For example, plastic compositions with or without strengthening matrices of fiberglass web or other conventional expedients can be used in carrying out principles of the present invention. It is generally desirable that ruptureable members break quickly so as to provide the vehicle-clearing timing indicated above. Further, sign stand assemblies of the "portable" type have been described for use with the present invention. In general, such sign stand assemblies are portable in the sense that they are not fixed to a roadway surface, a ground surface or the like support. Accordingly, sign stand assemblies according to the principles of the present invention are allowed to undergo upward movement, above the support surface.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A portable sign support arrangement, comprising:

a portable base including a leg support portion;

a force accumulator tube of hollow predetermined cross-section supported by the base;

a support tube;

at least one of said force accumulator tube and said support tube having a hollow cross-section for telescopic engagement in a close-sized fit with the other of said force accumulator tube and said support tube so as to have a predetermined portion of said support tube extending beyond the free edge of said force accumulator tube;

an insertion limiter cooperating with said force accumulator tube and said support tube so as to limit telescopic engagement of said support tube and said force accumulator tube, aligning said predetermined portion adjacent the free edge of said force accumulator tube; and said predetermined portion of said support tube including a plurality of weakening members adjacent the free edge of said force accumulator tube;

so that a lateral force applied to said sign support arrangement generally at or below said weakening members is accumulated at said free edge of said force accumulator tube and is developed at said predetermined portion of said support tube to sever said support tube into upper and lower portions and to impart rotation to said upper portion;

a spring member, including at least one generally upright spring coil, coupled to the leg support;

said force accumulator tube having a free edge spaced from the base and coupled to the spring coil through at least one bracket member secured to the force accumulator tube and at least one threaded fastener member; and a coil connector engaged with the spring coil and wherein said at least one bracket member is coupled to the coil connector by said at least one threaded fastener member.

2. The support arrangement of claim 1 wherein said support tube is inserted within said force accumulator tube.

3. The support arrangement of claim 1 wherein said weakening members comprise apertures in said support tube.

4. The support arrangement of claim 3 wherein said apertures comprise generally round holes.

5. The support arrangement of claim 1 wherein said base includes springs for resilient mounting of said force accumulator tube.

6. The support arrangement of claim 1 wherein said force accumulator tube is inserted within said support tube.

7. A portable sign support arrangement, comprising:

a portable base including a platform and a leg support portion;

a force accumulator tube of hollow predetermined cross-section pivotally supported by the base;

a support tube;

at least one of said force accumulator tube and said support tube having a hollow cross-section for telescopic engagement in a close-sized fit with the other of said force accumulator tube and said support tube so as to have a predetermined portion of said support tube extending beyond the free edge of said force accumulator tube;

a spring member resiliently coupling said force accumulator tube and said portable base;

an insertion limiter cooperating with said force accumulator tube and said support tube so as to limit telescopic engagement of said support tube and said force accumulator tube, aligning said predetermined portion adjacent the free edge of said force accumulator tube;

said spring member comprising a pair of generally upright spring coils coupled to said force accumulator tube by at least one bracket member secured to the force accumulator tube, a threaded connector member engaged with said spring coils and a threaded fastener member coupling said threaded connector member and said at least one bracket member; and said predetermined portion of said support tube including a plurality of weakening members adjacent the free edge of said force accumulator tube;

so that a lateral force applied to said sign support arrangement generally at or below said weakening members is accumulated at said free edge of said force accumulator tube and is developed at said predetermined portion of said support tube to sever said support tube into upper and lower portions and to impart rotation to said upper portion.

8. The support arrangement of claim 7 wherein said force accumulator tube is coupled to the spring coils through bracket members secured to the force accumulator tube by a threaded fastener member.

9. The support arrangement of claim 7 wherein said weakening members comprise apertures in said support tube.

10. The support arrangement of claim 7 wherein said support tube is inserted within said force accumulator tube.

11. The support arrangement of claim 7 wherein said force accumulator tube is inserted within said support tube.

* * * * *